US010819010B2

(12) United States Patent
Lee et al.

(10) Patent No.: US 10,819,010 B2
(45) Date of Patent: Oct. 27, 2020

(54) ELECTRONIC DEVICE INCLUDING ANTENNA

(71) Applicant: Samsung Electronics Co., Ltd., Gyeonggi-do (KR)

(72) Inventors: Hyung Joo Lee, Gyeonggi-do (KR); Gyu Sub Kim, Seoul (KR); Se Hyun Park, Gyeonggi-do (KR); Jae Bong Chun, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 465 days.

(21) Appl. No.: 15/380,479

(22) Filed: Dec. 15, 2016

(65) Prior Publication Data

US 2017/0170562 A1 Jun. 15, 2017

(30) Foreign Application Priority Data

Dec. 15, 2015 (KR) ..... 10-2015-0179242

(51) Int. Cl.

| | |
|---|---|
| ***H01Q 1/24*** | (2006.01) |
| ***H01Q 9/42*** | (2006.01) |
| ***H01Q 9/14*** | (2006.01) |
| ***H01Q 7/00*** | (2006.01) |

(52) U.S. Cl.

CPC ..... *H01Q 1/243* (2013.01); *H01Q 7/00* (2013.01); *H01Q 9/14* (2013.01); *H01Q 9/42* (2013.01)

(58) Field of Classification Search

CPC ..... H01Q 1/243; H01Q 9/14; H01Q 9/42; H01Q 21/30; H01Q 7/00

See application file for complete search history.

(56) References Cited

U.S. PATENT DOCUMENTS

| | | | |
|---|---|---|---|
| 7,420,511 | B2 | 9/2008 | Oshiyama et al. |
| 7,558,607 | B2 | 7/2009 | Edeler et al. |
| 9,041,617 | B2 | 5/2015 | Sorensen et al. |
| 9,065,165 | B2 | 6/2015 | Wong et al. |
| 9,070,968 | B2 | 6/2015 | Mow et al. |

(Continued)

FOREIGN PATENT DOCUMENTS

| | | |
|---|---|---|
| CN | 1766663 | 5/2006 |
| KR | 10-0924769 | 11/2009 |

OTHER PUBLICATIONS

International Search Report dated Apr. 6, 2017 issued in counterpart application No. PCT/KR2016/014670, 10 pages.

(Continued)

*Primary Examiner* — Daniel Munoz
*Assistant Examiner* — Bamidele A Jegede
(74) *Attorney, Agent, or Firm* — The Farrell Law Firm, P.C.

(57) ABSTRACT

An electronic device including an antenna is provided. The electronic device includes a ground plane, an antenna element that is electrically connected to the ground plane through a first electrical path, a receptacle that accommodates an external connector that is electrically connected to the ground plane and comprises a conductive line, and a control circuit that is configured to: detect whether the external connector is inserted into the receptacle, and change the first electrical path to a second electrical path or add the second electrical path to the first electrical path between the antenna element and the ground plane, when the external connector is inserted into the receptacle.

14 Claims, 20 Drawing Sheets

(56) References Cited

U.S. PATENT DOCUMENTS 9,077,078 B2 7/2015 Rodriguez De Luis et al.
9,373,883 B2 6/2016 Hwang et al.
9,431,693 B2 8/2016 Kwak et al.
9,491,007 B2 11/2016 Black et al.
9,923,272 B2 3/2018 Sorensen et al.
10,211,515 B2 2/2019 Hwang et al.
2003/0098812 A1* 5/2003 Ying ..... H01Q 1/243 343/702
2005/0181844 A1 8/2005 Edeler et al.
2006/0097918 A1* 5/2006 Oshiyama ..... H01Q 1/243 343/700 MS
2010/0244978 A1* 9/2010 Milosavljevic ..... H04B 1/0458 333/33
2012/0218723 A1* 8/2012 Kwak ..... H01Q 1/243 361/748
2013/0069583 A1* 3/2013 Lemelman ..... G06F 1/1635 320/107
2013/0154897 A1 6/2013 Sorensen et al.
2013/0257454 A1* 10/2013 Mow ..... H01Q 9/0421 324/619
2013/0265199 A1* 10/2013 Koskiniemi ..... G01S 19/14 342/450
2014/0078008 A1* 3/2014 Kang ..... H01Q 5/35 343/702
2014/0145900 A1 5/2014 Wong et al.
2014/0159982 A1 6/2014 De Luis et al.
2014/0168015 A1* 6/2014 Kim ..... H01Q 1/243 343/702
2014/0210675 A1* 7/2014 Hwang ..... H01Q 1/44 343/702
2014/0211067 A1* 7/2014 Penov ..... G06K 9/6202 348/333.03
2014/0253393 A1* 9/2014 Nissinen ..... H01Q 1/36 343/702
2015/0002348 A1* 1/2015 Wong ..... H01Q 1/243 343/724
2015/0097753 A1 4/2015 Liou et al.
2015/0255869 A1 9/2015 Sorensen et al.
2015/0270613 A1* 9/2015 Toh ..... H01Q 9/0442 343/876
2015/0312058 A1* 10/2015 Black ..... H04L 25/0278 455/77
2016/0301126 A1 10/2016 Hwang et al.
2018/0212312 A1 7/2018 Hwang et al.

OTHER PUBLICATIONS

Sun-gook Hwang et al., "A Reconfigurable Antenna for Mobile Handset Using RF Switch", The Journal of the Korea Institute of Intelligent Transport Systems, v.13 No. 5, 2014, pp. 21-26.
Chinese Office Action dated Apr. 23, 2019 issued in counterpart application No. 201680019923.9, 16 pages.
European Search Report dated Nov. 14, 2018 issued in counterpart application No. 16876030.4-1205, 24 pages.

* cited by examiner

ELECTRONIC DEVICE INCLUDING ANTENNA

PRIORITY

This application claims priority under 35 U.S.C. § 119(a) to Korean Patent Application Serial No. 10-2015-0179242, which was filed in the Korean Intellectual Property Office on Dec. 15, 2015, the entire disclosure of which is incorporated herein by reference.

BACKGROUND

1. Field of the Disclosure

The present disclosure relates generally to a technology that prevents an antenna performance deterioration of an electronic device, which supports a wireless communication function, when a cable is connected to the electronic device.

2. Description of the Related Art

An electronic device, such as a smartphone, may receive an external connector. For example, the electronic device may include a port for connecting the electronic device to various types of interfaces, such as a universal serial bus (USB) connector, an earphone jack, a data cable, a charging cable, and a high-definition multimedia interface (HDMI).

When the electronic device supports a wireless communication function, the electronic device may include an antenna for transmitting and receiving communication signals. For example, the electronic device may radiate electromagnetic waves through a metal antenna radiator provided in the housing of the electronic device. The electronic device may utilize a part of a metal frame that forms an external appearance of the electronic device as an antenna element, or may utilize a metal component mounted within the electronic device as an antenna element.

However, when an external connector is connected to the electronic device supporting the wireless communication function, the external connector may electrically contact a metal material, a metal component, and/or a metal frame that functions as an antenna in the electronic device.

Consequently, when the external connector (e.g., a cable including a metal member) is inserted into a port that is arranged in an area that is adjacent to a main radiator, the radiation performance of the electronic device may be lowered. For example, if the external connector and an antenna element in the electronic device contact each other, the resonance frequency and the resonance efficiency of the antenna may change because a current does flow along an intended path. Accordingly, when the user connects a USB connector or an earphone to the electronic device, a signal of a desired frequency band may not be received or a signal reception sensitivity of the electronic device may be lowered.

SUMMARY

The present disclosure is made to address at least the above-mentioned problems and/or disadvantages and to provide at least the advantages described below.

Accordingly, an aspect of the present disclosure is to provide various antenna structures for solving the above-described and problems occurring in conventional antenna designs.

In accordance with an aspect of the present disclosure, an electronic device is provided, which includes a ground plane; an antenna element that is electrically connected to the ground plane through a first electrical path; a receptacle that accommodates an external connector that is electrically connected to the ground plane and comprises a conductive line; and a control circuit that is configured to: detect whether the external connector is inserted into the receptacle, and change the first electrical path to a second electrical path or add the second electrical path to the first electrical path between the antenna element and the ground plane, when the external connector is inserted into the receptacle.

In accordance with another aspect of the present disclosure, an electronic device is provided, which includes a ground plane; a receptacle that accommodates an external connector; a first antenna radiator; a second antenna radiator; a feeding unit that feeds electricity to the first antenna radiator; a first switch that connects the first antenna radiator and the ground plane; a second switch that selectively connects the feeding unit to the first antenna radiator or the second antenna radiator; a third switch that connects the first antenna radiator and the second antenna radiator; and a control circuit, which is electrically connected to at least one of the first switch, the second switch, and the third switch, wherein the control circuit is configured to short-circuit the first switch and the third switch, and to connect the second switch to the second antenna radiator, in response to the external connector being inserted into the receptacle.

In accordance with another aspect of the present disclosure, an electronic device is provided, which includes a ground plane; a receptacle that accommodates an external connector; a first antenna radiator; a second antenna radiator; a feeding unit that feeds electricity to the first antenna radiator or the second antenna radiator; a first switch that connects the first antenna radiator and the ground plane; a second switch that selectively connects the feeding unit to the first antenna radiator or the second antenna radiator; and a control circuit that is electrically connected to at least one of the first switch or the second switch, wherein the control circuit is configured to short-circuit the first switch and connect the second switch to the second antenna radiator, if the external connector is inserted into the receptacle.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1A:
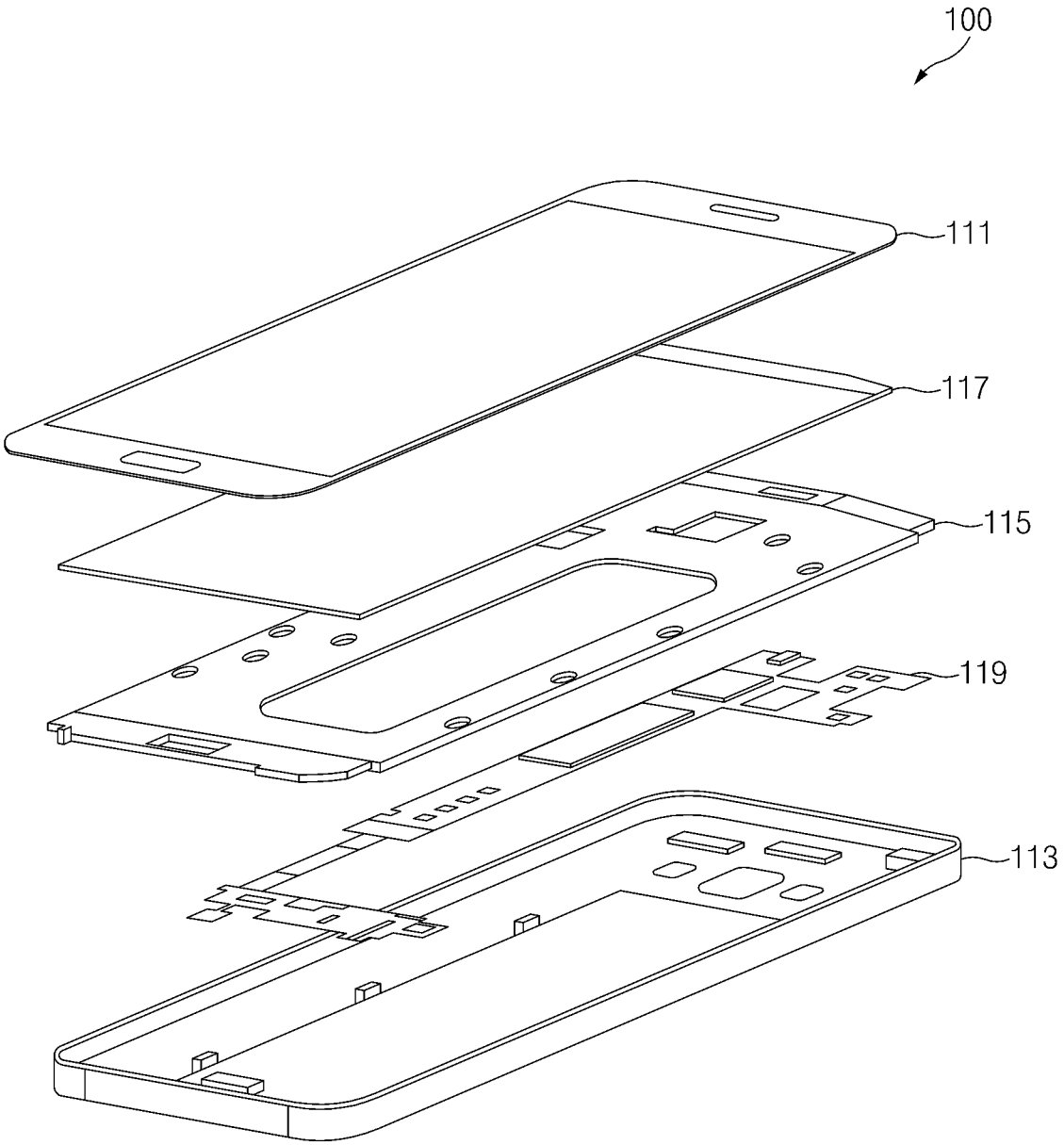
FIG. 1A is an exploded perspective view illustrating an electronic device according to an embodiment of the present disclosure.

Hereinafter, various embodiments of the present disclosure are described with reference to the accompanying drawings. However, the present disclosure is not intended to be limited by these specific embodiments and is intended to cover all modifications, equivalents, and/or alternatives thereof, provided they come within the scope of the appended claims and their equivalents.

With respect to the descriptions of the accompanying drawings, like reference numerals may refer to like elements.

Terms used to describe the various embodiments of the present disclosure are not intended to limit the scope of other embodiments.

Similarly, the terms and words used in the following description and claims are not limited to their dictionary meanings, but are merely used to provide a clear and consistent understanding of the present disclosure. Accordingly, it should be apparent to those skilled in the art that the following description of various embodiments of the present disclosure is provided for illustration purposes only and not for the purpose of limiting the present disclosure as defined by the appended claims and their equivalents.

All terms used herein may have the same meanings that are generally understood by a person skilled in the art. In general, terms defined in a dictionary should be considered to have the same meanings as the contextual meanings in the related art, and unless clearly defined herein, should not be understood differently or as having excessively formal meanings. Even the terms defined in the present specification are not intended to be interpreted as excluding embodiments of the present disclosure.

Terms of a singular form may include plural forms unless they have a clearly different meaning in the context.

Singular forms, such as "a," "an," and "the," may include plural referents unless the context clearly dictates otherwise. Thus, for example, reference to "a component surface" includes reference to one or more of such surfaces.

The terms "include," "comprise," "have", "may include," "may comprise" and "may have" indicate disclosed functions, operations, and/or existence of elements, but do not exclude other functions, operations, and/or elements.

The expressions "A or B" and "at least one of A and/or B" may indicate (1) at least one A, (2) at least one B, or (3) both at least one A and at least one B.

The terms, such as "1st," "2nd," "first," "second," etc., may modify different elements of various embodiments of the present disclosure, but are not intended to limit the elements. For example, "a first user device" and "a second user device" may indicate different user devices, regardless of order or importance. Similarly, a first component may be referred to as a second component, and vice versa, without departing from the scope and spirit of the present disclosure.

When a component (e.g., a first component) is referred to as being "operatively or communicatively coupled with/to" or "connected to" another component (e.g., a second component), the first component may be directly connected to the second component or indirectly connected to the second component, through another component (e.g., a third component). However, when the first component is referred to as being "directly connected to" or "directly accessed by" the second component, no other component (exists therebetween.

The term "configured to" may be interchangeably used with "suitable for," "having the capacity to," "designed to," "adapted to," "made to," or "capable of" according to the context. The term "configured to" may not necessarily indicate "specifically designed to" in terms of hardware. Instead, the expression "a device configured to" in some contexts may indicate that the device and another device or part are "capable of." For example, "a processor configured to perform A, B, and C" may indicate a dedicated processor (e.g., an embedded processor) for performing a corresponding operation or a general purpose processor (e.g., a central processing unit (CPU) or an application processor (AP)) for performing corresponding operations by executing at least one software program stored in a memory device.

An electronic device according to an embodiment of the present disclosure may include a smartphone, a tablet personal computer (PC), a mobile phone, a video telephone, an electronic book reader, a desktop PC, a laptop PC, a netbook computer, a workstation, a server, a personal digital assistant (PDA), a portable multimedia player (PMP), a Motion Picture Experts Group (MPEG-1 or MPEG-2) Audio Layer 3 (MP3) player, a mobile medical device, a camera, or a wearable device. The wearable device may include an accessory-type device (e.g., a watch, a ring, a bracelet, an anklet, a necklace, glasses, a contact lens, a head-mounted device (HMD)), a textile- or clothing-integrated-type device (e.g., an electronic apparel), a body-attached-type device (e.g., a skin pad or a tattoo), or a bio-implantable-type device (e.g., an implantable circuit)

An electronic device may also be a home appliance, such as a television (TV), a digital video/versatile disc (DVD) player, an audio, a refrigerator, an air conditioner, a cleaner, an oven, a microwave oven, a washing machine, an air cleaner, a set-top box, a home automation control panel, a security control panel, a television (TV) box (e.g., Samsung HomeSync™, Apple TV™, or Google TV™), a game console (e.g., Xbox™ or PlayStation™), an electronic dictionary, an electronic key, a camcorder, or an electronic picture frame An electronic device may also be a medical device (e.g., a portable medical measurement device (e.g., a blood glucose measuring device, a heart rate measuring device, a blood pressure measuring device, a body temperature measuring device, etc.), a magnetic resonance angiography (MRA) device, a magnetic resonance imaging (MRI) device, a computed tomography (CT) device, a scanner, an ultrasonic device, etc.), a navigation device, a global navigation satellite system (GNSS), an event data recorder (EDR), a flight data recorder (FDR), a vehicle infotainment device, electronic equipment for vessels (e.g., a navigation system, a gyrocompass, etc.), avionics, a security device, a head unit for a vehicle, an industrial or home robot, an automatic teller machine (ATM), a point of sales (POS) device, or an Internet of things (IoT) device (e.g., a light bulb, a sensor, an electric or gas meter, a sprinkler, a fire alarm, a thermostat, a streetlamp, a toaster, exercise equipment, a hot water tank, a heater, a boiler, etc.).

An electronic device may also be a part of furniture or a building/structure, an electronic board, an electronic signature receiving device, a projector, and/or a measuring instrument (e.g., a water meter, an electricity meter, a gas meter, a wave meter, etc.).

An electronic device may also be a flexible device.

An electronic device may also be a combination of the above-mentioned devices.

An electronic device, however, is not limited to the above-mentioned devices, and may include new electronic devices with the development of new technology.

Herein, the term "user" may refer to a person who uses an electronic device or may refer to a device (e.g., an artificial intelligence electronic device) that uses an electronic device.

FIG. 1A is an exploded perspective view illustrating an electronic device according to an embodiment of the present disclosure.

Referring to FIG. 1A, the electronic device 100 includes a housing that forms an external appearance of the electronic device 100. Various electronic components may be mounted inside of the housing.

The housing includes a first surface (e.g., a front surface), a second surface (e.g., a rear surface) opposite the first surface, and a third surface (e.g., a side surface) that at least partially surrounds a space between the first surface and the second surface.

Specifically, the housing includes a front cover 111 that is arranged on the front surface of the electronic device 100 and a rear cover 113 that surrounds the rear surface and the side surfaces of the electronic device 100. The front cover 111 covers a display 117, a microphone, and a speaker of the electronic device 100, which are seated in a bracket 115, to physically protect the internal modules from an external impact. The front cover 111 may have a size that is the same as or similar to that of the bracket 115, and may include a layer to which a bonding material is applied or bonded in at least an area of the front cover 111, which contacts the bracket 115 such that the front cover 111 may be fixed to the bracket 115. The front cover 111 may be attached to or detached from the bracket 115. For example, the front cover 111 may be fixed to the bracket 115 at a point at which the front cover 111 contacts the bracket 115 through a screw member or the like.

An area of the front cover 111 may be implemented by a transparent material, such that an area of the front cover 111 is transparent. For example, the front cover 111 may include a glass window. Accordingly, a screen that is output through the display 117 arranged under the front cover 111 may be displayed to the outside through the transparent area of the front cover 111.

The rear cover 113 may be arranged under the bracket 115. The rear cover 113 may surround the internal modules arranged between the front cover 111 and the rear cover 113, the bracket 115, a printed circuit board 119, etc., from the rear side and the lateral sides of the electronic device 100. A bonding material may be applied to an area of the rear cover 113, which the bracket 115, the printed circuit board 119, etc., contacts, or a bonding layer may be included in the rear cover 113, such that the bracket 115, the printed circuit board 119, etc., may be fixed to the rear cover 113.

The rear cover 113 may be attached to or detached from the bracket 115. For example, the rear cover 113 may be fixed to the bracket 115 at a point at which the rear cover 113 contacts the bracket 115 through a boss, a stopper member, a hook member, etc.

The rear cover 113 may include an opening. The rear cover 113 may be arranged on the printed circuit board 119 while having an opening at a central upper end area thereof, or may allow a camera module or the like, which is connected to the printed circuit board 119 to be exposed to the outside. The rear cover 113 may be arranged on the printed circuit board 119 and may have a microphone or speaker hole at a location corresponding to the microphone or the speaker, such that sounds may be introduced into or discharged from the microphone or the speaker connected to the printed circuit board 119. The rear cover 113 may also include an input/output terminal hole through which an external input/output terminal may be connected.

The bracket 115 is arranged between the display 117 and the printed circuit board 119 to support and fix the structures arranged within the electronic device 100. Alternatively, the bracket 115 may be arranged between the printed circuit board 119 and the rear cover 113. For example, one or more brackets 115 may be coupled to each other or may be independently arranged within the electronic device 100.

The bracket 115 may include an opening. An internal module may be connected to the printed circuit board 119 through the opening in the bracket 115. The number, the forms, and/or the locations of the openings of the bracket 115 may be different depending on the number, the forms, and/or the locations of modules, which are connected to the printed circuit board 119.

The display 117 may be arranged on the bracket 115 to display various contents (e.g., a text, an image, a video, an icon, and a symbol). The display 117 may include a touch screen and, therefore, may receive a touch, a gesture, a proximity, and/or a hovering input using an electronic pen or the body of the user.

The printed circuit board 119 is arranged under the bracket 115, and various electronic components 171 may be mounted on the printed circuit board 119. For example, at least one electronic element and circuit lines may be mounted on the printed circuit board 119, and at least some of them may be electrically connected to each other. The electronic components may include a processor, a memory, and a radio frequency (RF) block.

Although various elements of the electronic device 100 are illustrated in FIG. 1A, the electronic device 100 may include other elements, in addition to or instead of the above-mentioned elements. For example, the electronic device 100 may further include a battery 190 (shown in FIG. 1B) and a battery cover that surrounds the battery 190 under the rear cover 113. The rear cover 113 may include a battery coupler such that the battery 190 may be coupled to the rear cover 113, and the battery 190 may be electrically connected to the printed circuit board 119 through the battery coupler.

Figure 1B:
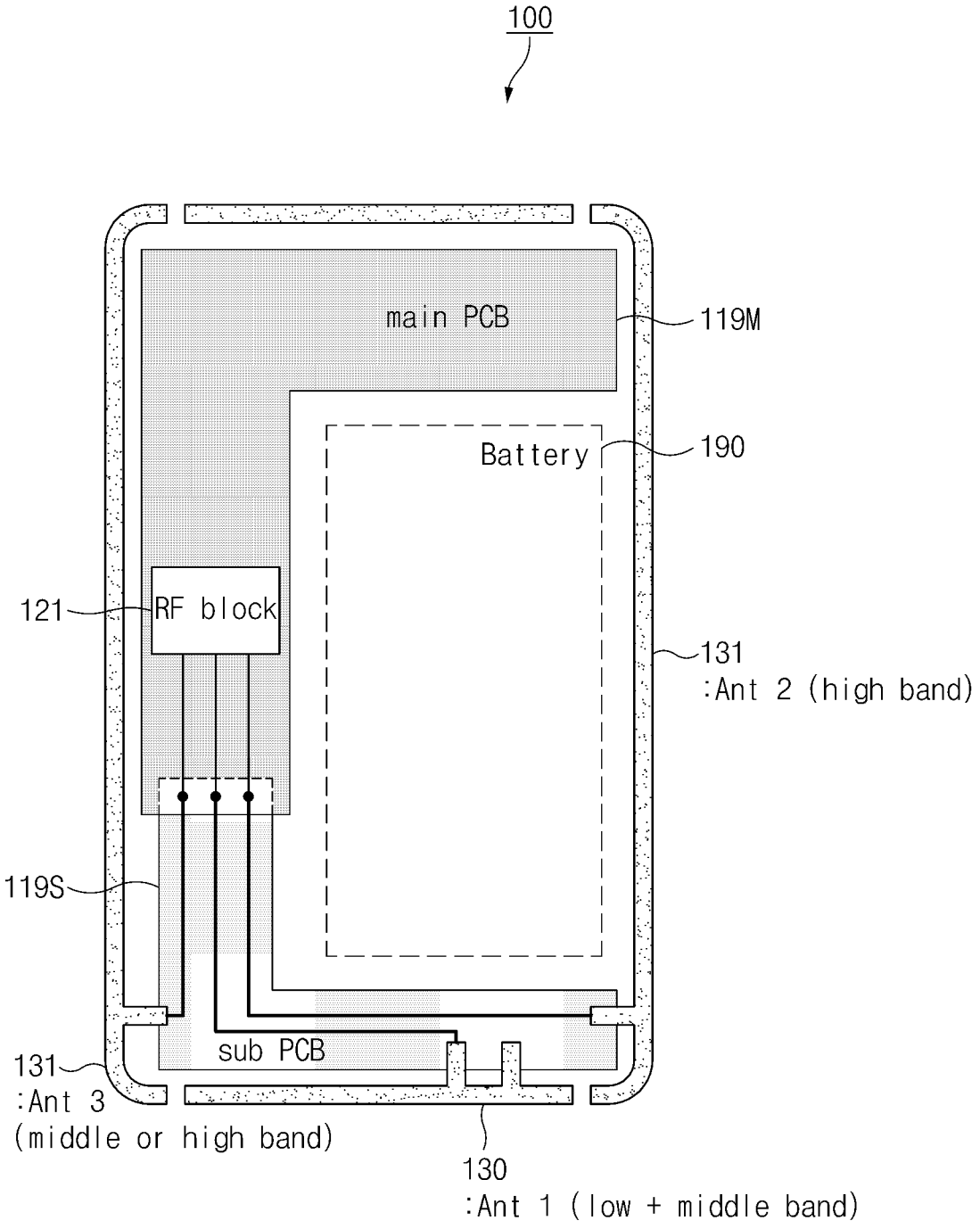
FIG. 1B illustrates an antenna element of an electronic device according to an embodiment of the present disclosure.

FIG. 1B illustrates an antenna element of an electronic device according to an embodiment of the present disclosure.

Referring to FIG. 1B, the electronic device 100 includes a metal frame that forms a side housing and is utilized as an antenna element. For example, when the electronic device 100 supports long-term evolution (LTE) communication, the electronic device 100 may transmit and receive signals of a low frequency band and a middle frequency band by using an antenna element 130 as a first antenna. The electronic device 100 may transmit and receive signals of a high frequency band by using an antenna element 131 as a second antenna. The electronic device 100 may transmit and receive signals of a middle frequency band and a high frequency band by using an antenna element 133 as a third antenna.

The low frequency band may correspond to a frequency band in a range of about 600 MHz to 1000 MHz, and the middle frequency band may correspond to a frequency band in a range of 1400 MHz to 2200 MHz. The high frequency band may correspond to a frequency band in a range of 2300 MHz to 3800 MHz.

Additionally, the electronic device 100 may include various antenna elements, which may be utilized to transmit and receive signals of various frequency bands based on the electrical lengths or radiation characteristics thereof. For example, the electronic device 100 may transmit and receive signals of a LTE low/middle/high band or a global system for mobile communication (GSM) or wideband code division multiple access (WCDMA) frequency band, or a frequency band (e.g., 2.4 GHz/5 GHz) of Bluetooth or Wi-Fi through various antenna elements.

The signals received through an antenna of the electronic device 100 may be delivered to a control circuit (e.g., a CPU, an AP, and/or a CP) through an electrical path that connects one point of the antenna and an RF block 121. For example, the RF block 121 may be situated on a main PCB 119M, or may be situated in a sub-PCB 119S. When electricity is supplied from one point of the sub-PCB 119S to the antenna and the RF block 121 is situated on the main PCB 119M, a signal may be delivered from the antenna to the RF block 121 through a contact point of the main PCB 119M and the sub-PCB 119S. Suitable hardware modules (e.g., a front-end module (FEM), a filter, and an amplifier) may be provided between the antenna (radiator) and the RF block 121, or between the RF block 121 and a control circuit connected to the RF block 121.

Figure 1C:
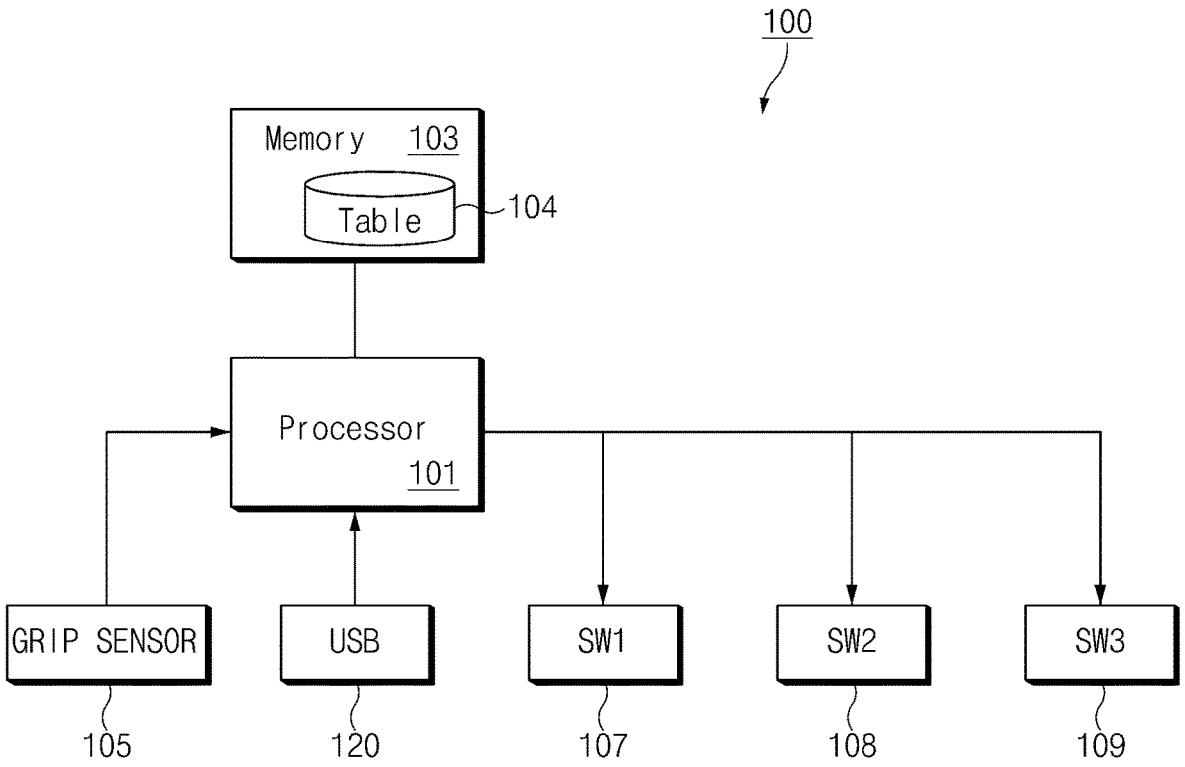
FIG. 1C illustrates an electronic device for controlling a switch in correspondence to connection of an external connector according to an embodiment of the present disclosure.

FIG. 1C illustrates an electronic device for controlling a switch in correspondence to connection of an external connector according to an embodiment of the present disclosure.

Referring to FIG. 1C, the electronic device 100 includes a processor 101, a memory 103, a USB port 120, a switch 107, a switch 108, and a switch 109. The switches 107, 108, and 109 may be arranged at a suitable location to change an electrical path of the antenna, a pattern of the antenna, and/or a main radiator based on insertion of an external connector into a USB port 120 (or another receptacle to which the external connector may be connected). A structure of the electronic device 100, to which an external connector may be connected, may be referred to as a receptacle, a port, a jack, a terminal, a connector, an accommodation part, a coupler, etc.

Although FIG. 1C illustrates three switches 107, 108, and 109 in the electronic device 100, the number of switches may vary.

The electronic device 100 also includes a grip sensor 105. The processor 101 may control the switches 107, 108, and 109 depending on a value sensed by the grip sensor 105. The processor 101 may determine whether the electronic device 100 is gripped by the left hand of the user or is gripped by the right hand of the user, or the radiation performance is lowered on the left side of the electronic device 100 or is lowered on the right side of the electronic device 100, and may improve radiation performance by controlling the switches 107, 108, and 109 based on the determination result.

The processor 101 may be understood as a control circuit that controls a state (e.g., "opened"/"short-circuited" or "OFF"/"ON") of at least one of the switches 107, 108, and 109. The processor 101 may change a state of a switch with reference to a table 104 stored in the memory 103. For example, the processor 101 may be configured to short-circuit the first switch 107 based on the table 104, connect the second switch 108 to an antenna element (radiator), and short-circuit the third switch 109, if a USB connector is inserted into the USB port 120.

Figure 2:
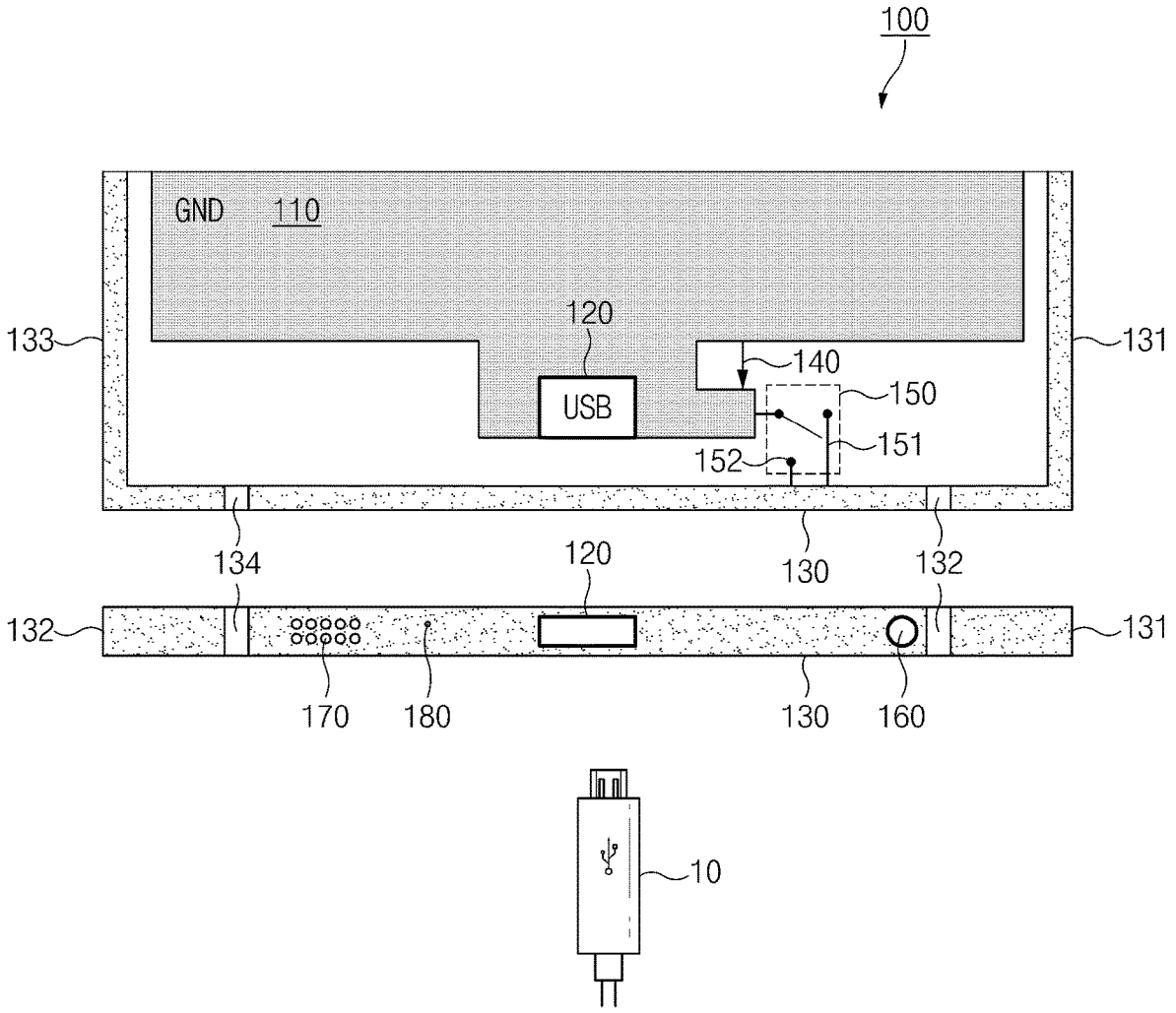
FIG. 2 illustrates an antenna including a switch for changing a point connected to a radiator in correspondence to insertion of an external connector according to an embodiment of the present disclosure.

FIG. 2 illustrates an antenna including a switch for changing a point connected to a radiator in correspondence to insertion of an external connector according to an embodiment of the present disclosure. Specifically, an upper portion of FIG. 2 illustrates the electronic device 100 positioned in an x-y plane along a z direction, a middle portion of FIG. 2 illustrates the electronic device 100 along the x direction, and a lower portion of FIG. 2 illustrates an external connector 10.

Referring to FIG. 2, the electronic device 100 includes a USB port 120 and/or an earphone jack 160, i.e., two different receptacles in which external connectors are received.

The electronic device 100 includes a ground plane 110, the USB port 120, the antenna element 130, a feeding unit (or feeding network) 140, and a switch 150. In addition, the electronic device 100 includes a speaker 170, the earphone jack 160, and a microphone 180.

The ground plane 110 may be situated within a housing. The housing of the electronic device 100 may be implemented in various forms, and is not limited to the examples illustrated in FIGS. 2, 4A, and 5A.

The antenna element 130 may be implemented as a part of the housing. For example, the electronic device 100 may use a part of a metal frame that surrounds a side surface of the electronic device as the antenna element 130. The side surface of the housing of the electronic device 100 includes a first side member 130, a second side member 131, and a third side member 133, which are formed of a metal material. In this example, the first side member 130 may function as the antenna element 130, and may have a length suitable for receiving a signal of a desired frequency band. For example, in order to secure a suitable length of the first side member 130, a first insulation area 132 may be inserted between the first side member 130 and the second side member 131 and a second insulation area 134 may be inserted between the first side member 130 and the third side member 133.

The antenna element 130 includes an opening through which the external connector 10, i.e., the USB connector, may be coupled to the USB port 120.

Although the top portion of FIG. 2 illustrates the USB port 120 and the antenna element 130 being spaced apart from each other, the USB port 120 may contact the side member (or the opening provided in the side member). Similarly, an interior space of the electronic device 100 (indicated as white space in FIG. 2) may be filled with other suitable components, a substrate, a carrier, an injection-molded product, an insulation material, etc.

Alternatively, a separate metal material, a metal component, and/or a metal outer shape (surface) of a component, which is arranged within the electronic device 100, may correspond to the antenna element. In this case, the antenna element may be electrically influenced by insertion of the external connector 10. For example, an electrical path associated with an antenna element may be changed if the external connector 10 is inserted, and accordingly, a signal reception sensitivity of a signal of a frequency band that is targeted by the electronic device 100 may be lowered. The following designs may be used for the electronic device 100 to more efficiently receive a signal of a desired frequency band.

In accordance with an embodiment of the present disclosure, some of the side members of the electronic device 100 may be omitted. For example, when the electronic device 100 includes a side display or a side/curved display that extends form a front display, a side member corresponding to an area in which the side display is situated may be omitted. In this case, the side display may contact a lower plate (for example, a rear cover) of the housing.

The housing of the electronic device 100 may include an upper plate (e.g., the front cover 111) that may accommodate a display unit (for example, an LCD or OLED panel) of the electronic device 100, and a lower plate (for example, the rear cover 113). For example, when the electronic device 100 is a foldable device, the housing of the electronic device 100 may include a plurality of plates. The side members may be separated from an upper plate, a lower plate, or a plurality of plates. Alternatively, at least some of the side members may extend from at least one of the upper plate or the lower plate to be integrally formed.

The ground plane 110 may correspond to a ground layer of a plurality of layers that forms a PCB (e.g., the PCB 119) situated within the housing of the electronic device 100. In addition to the PCB or alternatively, the ground plane 110 may be expanded to a layer included in the display panel or another part of the housing.

The receptacle 120 (and/or the receptacle 160) may be electrically connected to the ground plane 110. In this case, the receptacle 120 may be connected to the ground plane 110 by using an inductor. The electronic device 100 may pass a direct current (DC) component, but may not pass an alternative current (AC) component through the inductor. The structure may prevent a high frequency or low frequency signal generated by the external connector 10 or the receptacle 120 from lowering the performance of the antenna while not influencing transmission of control signals/data provided to a control circuit or an electronic component.

The electronic device 100 may include a control circuit (e.g., the processor 101). For example, the electronic device 100 may include an AP or a communication processor (CP). The control circuit may be electrically connected to the feeding unit 140, and may feed electricity to the antenna radiator.

The control circuit may detect whether the external connector 10 is inserted into the receptacle 120. For example, if the external connector 10 is inserted into the receptacle 120, the control circuit may detect this and control the switch 150.

A control circuit that supplies a current to the antenna through the feeding unit 140 may be the same as a control circuit that detects whether the external connector 10 is inserted into the receptacle 120, but they may be different control circuits in another embodiment. For example, the control circuit for feeding electricity may correspond to the processor of the electronic device 100, such as an AP or a CP. The control circuit that determines whether the external connector 10 is inserted may correspond to a circuit within the receptacle 120 that generates a flag signal (e.g., a 0 or 1) when the external connector 10 is inserted into the receptacle 120. If it is recognized that the external connector 10 is inserted into the receptacle 120, the control circuit may deliver a signal for controlling the switch 150 to the switch directly or indirectly based on a signal that indicates the insertion or the insertion.

The switch 150 may change an electrical path along which a current supplied through the feeding unit 140 flows. For example, when a control signal indicating that the external connector 10 is inserted is received, the switch 150 may open a connection to the first terminal 151 and may short-circuit a connection to the second terminal 152. In this case, the first electrical path that is formed through the first terminal 151 between the antennal element 130 and the ground plane 110 may be changed to a second electrical path formed through the second terminal 152. A change of a resonance frequency band based on the electrical path will be described in more detail with reference to FIGS. 3A and 3B below.

Figure 3A:
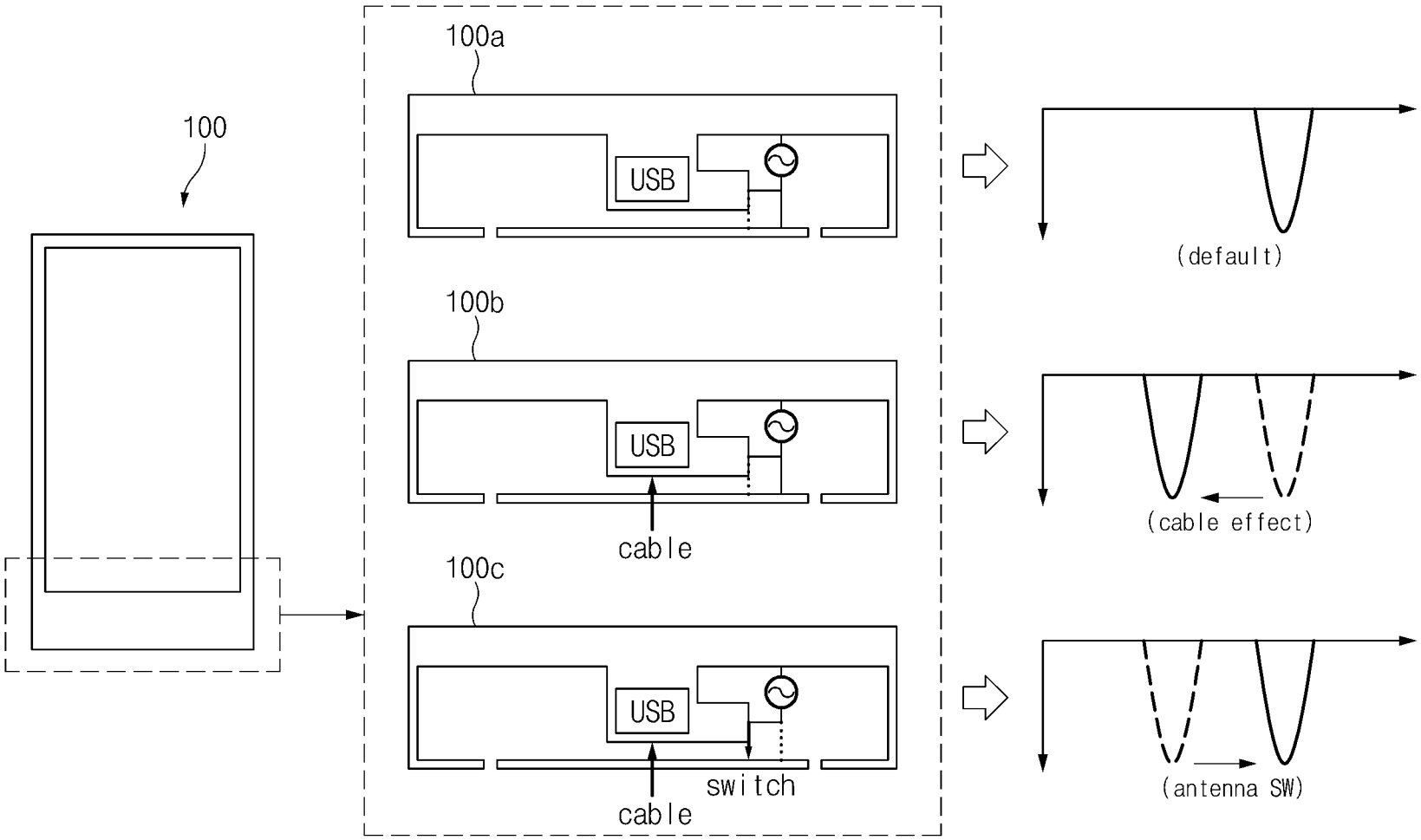
FIG. 3A illustrates a change of a resonance frequency band when a switch is controlled before an external connector is connected to an electronic device, while the external connector is connected to the electronic device, and when the external connector is connected to the electronic device, according to an embodiment of the present disclosure.

FIG. 3A illustrates a change of a resonance frequency band when a switch is controlled before an external connector is connected to an electronic device, while the external connector is connected to the electronic device, and when the external connector is connected to the electronic device, according to an embodiment of the present disclosure. Specifically, FIG. 3A illustrates a change of a resonance frequency band of an antenna situated at a lower end of the electronic device 100 when the external connector 10, such as a USB cable, is inserted into the USB port at the lower end (e.g., a dotted area) of the electronic device 100.

In a default state 100*a*, in which the external connector 10 is not coupled to the electronic device 100, the electronic device may receive a signal of a targeted frequency band. When the external connector 10 (cable) is inserted into the electronic device 100 in a state 100*b*, a metal component included in the external connector 10 influences an electrical path for receiving the signal, and as a result, a frequency band at which the electronic device 100 may transmit and receive signals may be changed. The electronic device 100 may adjust an electrical path through the switch 150, if the external connector 10 is inserted in a state 100*c*. Through the adjusted electrical path, the electronic device 100 may receive a signal of a frequency band that may be received in state 100*a*.

Figure 3B:
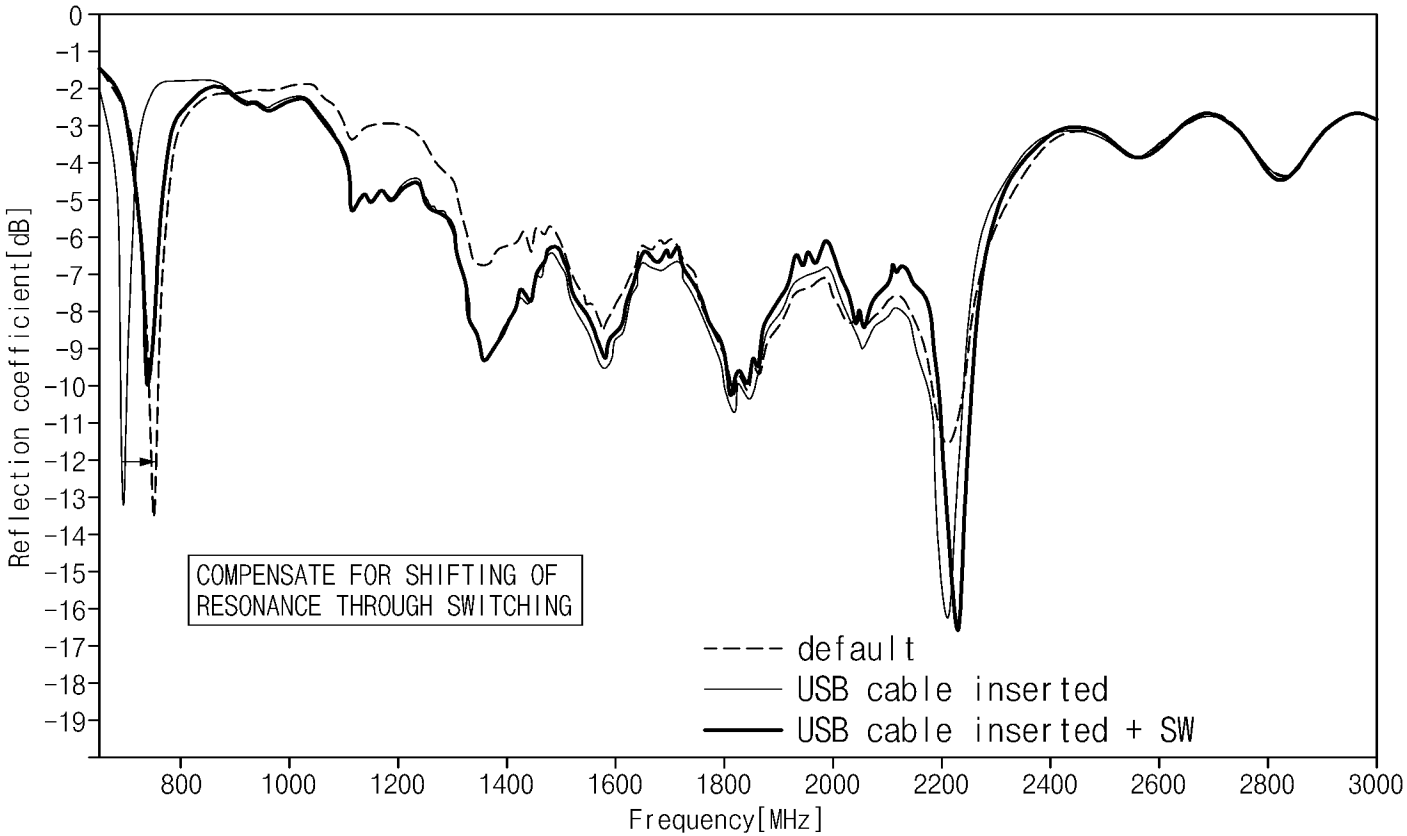
FIG. 3B is a graph depicting a change of a resonance frequency when a switch structure is applied to a smartphone that supports wireless communication according to an embodiment of the present disclosure.

FIG. 3B is a graph depicting a change of a resonance frequency when a switch structure is applied to a smartphone that supports wireless communication according to an embodiment of the present disclosure.

Referring to FIG. 3B, a reflection coefficient in a basic state, i.e., when the USB cable is not connected to the smartphone, is indicated by a dotted line. In FIG. 3B, the smartphone may receive a signal of a frequency band, of which the central frequencies are about 800 MHz and 2200 MHz.

A reflection coefficient when the USB cable is connected to the smartphone is indicated by a solid line. As compared with the reflection coefficient indicated by the dotted line, a resonance frequency (about 800 MHz) of a low frequency band is shifted to a lower frequency band (about 700 MHz). For example, because the electrical path formed by an existing antenna structure is branched or extended due to the insertion of the USB cable, a structure that is suitable for receiving a signal of a lower frequency band may be achieved. In this case, the smartphone may not smoothly receive a signal of an existing frequency band of 800 MHz.

A reflection coefficient when the USB cable is connected to the smartphone and control of a switch is applied is indicated by a thick solid line. As compared with the reflection coefficient indicated by the solid line, the frequency band is shifted to the vicinity of 800 MHz again.

In the graph indicated by a solid line, it can be seen that an existing electrical path may be unintendedly deformed due to insertion of a USB cable, and accordingly, a resonance frequency band is shifted to a relatively low frequency band. The low resonance frequency may mean that the electrical path for reception of a signal becomes longer, and the resonance frequency band may be recovered by a switch structure that may shorten the electrical path. For example, the electronic device 100 illustrated in FIG. 2 may have a relatively short electrical path, when the electrical path extending from the feeding unit 140 is connected to the second terminal 152, as compared with when the electrical path is connected to the first terminal 151. As the shortened electrical path is compensated for by an electrical path that is extended by the external connector 10, the electronic device 100 may recover a resonance frequency in a basic state. The description above corresponds to a low frequency band. For a high frequency band, i.e., when an electrical path that extends from the antenna element 130 to the first insulation area 132, the electrical path is longer when the electrical path extending from the feeding unit 140 is connected to the second terminal 152.

Figure 4A:
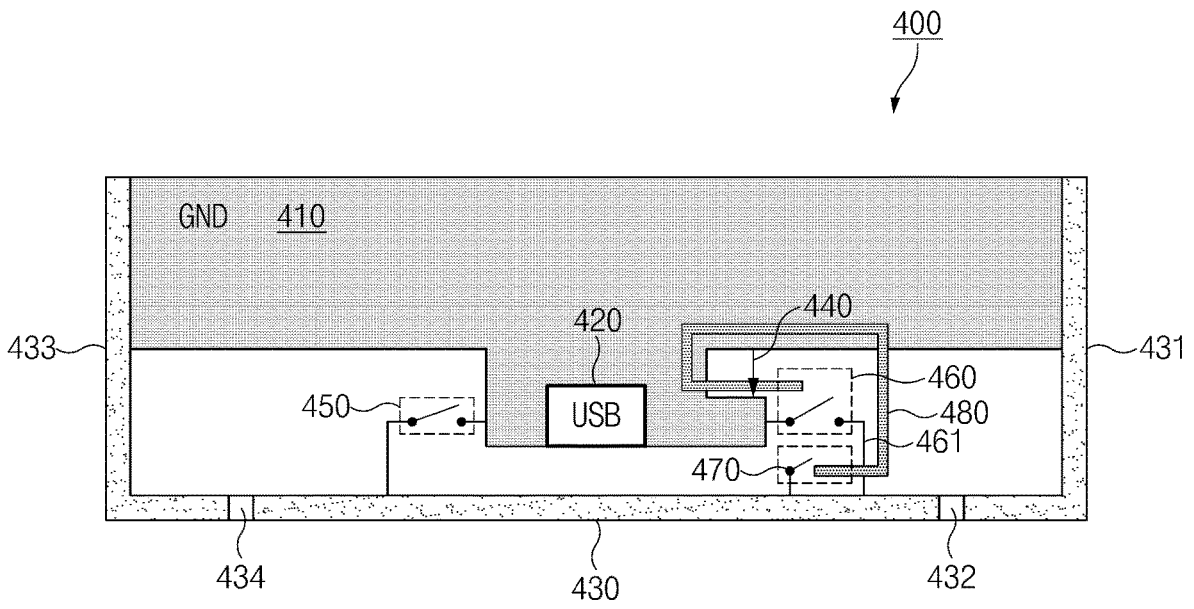
FIG. 4A illustrates an antenna including a switch for changing a type of an antenna in correspondence to insertion of an external connector according to an embodiment of the present disclosure.

FIG. 4A illustrates an antenna including a switch for changing a type of an antenna in correspondence to insertion of an external connector according to an embodiment of the present disclosure.

Referring to FIG. 4A, an electronic device 400 includes a ground plane 410, a receptacle 420, e.g., a USB port, a first antenna element 430, a feeding unit 440, a first switch 450, a second switch 460, a third switch 470, and a second antenna element 480. The ground plane 410, the receptacle 420, the first antenna element 430, the feeding unit 440, a right side member 431, a left side member 433, a first insulation area 432, and a second insulation area 434 of the electronic device 400 correspond to the ground plane 110, the receptacle 120, the first antenna element 130, the feeding unit 140, the first side member 431, the second side member 433, the first insulation area 432, and the second insulation area 434 of the electronic device 100, respectively. Accordingly, a repetitive description of these components has been omitted.

In the electronic device 400 of FIG. 4A, the ground plane 410, the right side member 431, and the left side member 433 physically contact each other. However, in the electronic device 100 of FIG. 2 (and an electronic device 500 of FIG. 5A), the corresponding configurations are spaced apart from each other.

Referring again to FIG. 4A, the first switch 450 may connect the first antenna element 430 and the ground plane 410. When an external connector is inserted into the receptacle 420, the performance of the antenna may be significantly lowered due to insertion of the external connector, if amplitude of an electrical field of a space in which an antenna pattern and the external connector 10 overlap each other is large. Accordingly, an influence of the external connector 10 on wireless communication may be decreased by adding an element that grounds the antenna near the receptacle 420, and thus weakening the electric field around the receptacle 420. For example, the electronic device 100 may be configured such that the first switch 450 is short-circuited if the first switch 450 is arranged between one point of the first antenna element 430 and the ground area 410 near the receptacle 420 and the external connector is inserted into the receptacle 420. The receptacle 420 may be electrically connected to the ground plane 410, and the first switch 450 may be arranged to be physically connected to the receptacle 420.

Further, the switch 450 may include at least one lumped element (e.g., an inductor). The lumped element may substantially extend an electrical length of the first antenna element 430 connected to the first switch 450.

The second switch 460 may selectively connect the first antenna element 430 and the second antenna element 480. For example, the second switch 460 may be operated to open connection to the first antenna element 430 and short-circuit connection to the second antenna element 480, or vice versa.

The feeding unit 440 may feed electricity to the first antenna element 430 or the second antenna element 480 depending on the connection state of the second switch 460.

The third switch 470 may connect one point of the second antenna element 480 and one point of the first antenna element 430. For example, the third switch 470 may be connected to the second antenna element 480, when the external connector is inserted, and may be maintain opened from the second antenna element 480, when the external connector is not inserted.

The second antenna 480 is an antenna radiator that does not form an outer frame of the electronic device 400, and may be situated within the housing of the electronic device 400. The second antenna element may be implemented by one of a thin film antenna (TFA), a flexible printed circuit board (FPCB), a bracket, and/or stainless use steel (SUS). The second antenna element 480 may be implemented by a laser direct structuring (LDS) antenna on a surface of a carrier that is formed within the electronic device 400 through injection-molding or the like. The second antenna element 480 may be connected to the second switch 460 and the third switch 470 through a C clip or a pogo pin.

The electronic device 400 may include a control circuit, which may be connected to at least one of the first switch 450, the second switch 460, and the third switch 470. The control circuit may be connected to all the switches to transmit a control signal to all the switches. However, the control circuit may transmit a control signal to some switches connected thereto. For example, when the second switch 460 and the third switch 470 interwork with each other electrically or mechanically, the control circuit also may control another switch by transmitting a control signal to any one of the switches. For example, if the external connector is inserted into the receptacle 420, the control circuit may short-circuit the first switch 450, connect the second switch 460 connected to the first antenna element 430 to the second antenna element 480, and short-circuit the third switch 470. If the external connector 10 is removed from the receptacle 420, the control circuit may perform the reverse operations.

Figure 4B:
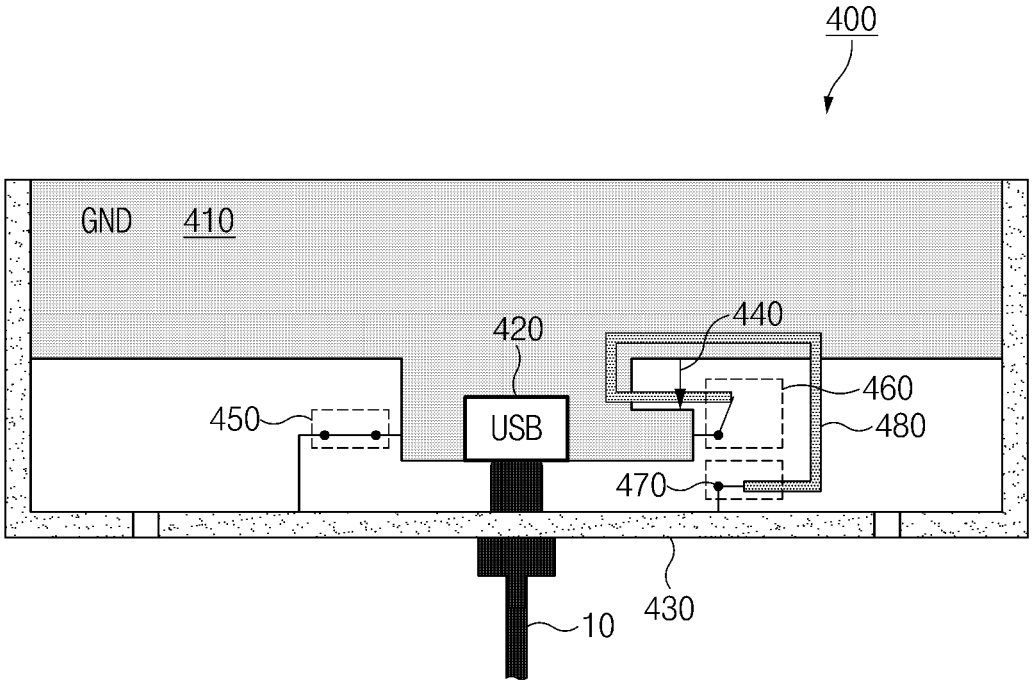
FIG. 4B illustrates a location of a switch when an external connector is inserted into an electronic device according to an embodiment of the present disclosure.

FIG. 4B illustrates a location of a switch when an external connector is inserted into an electronic device according to an embodiment of the present disclosure.

Referring to FIG. 4B, as the first switch 450 is short-circuited, the type of the antenna may be changed from an antenna (e.g., an inverted-F antenna (IFA)) having a length of $\lambda/4$ to an antenna (e.g., a slot antenna) having a length of $\lambda/2$. The length of the antenna for resonance of a low frequency band may be compensated for by the second antenna element 480.

When the external connector 10 is inserted into the receptacle 420, the type of the antenna may be changed from an IFA type to a loop antenna type under the control of a switch. For example, when the second switch 460 connects a terminal 461 and the second antenna element 480 and the feeding unit 440 feeds electricity to the terminal 461 (or feeds electricity to an arbitrary point on the right side of the terminal 461), the antenna elements of the electronic device 100 may be operated in a loop antenna type, if the first switch 450 and the third switch 470 are short-circuited.

The control circuit may control the switches or feeding of electricity based on an operation table (e.g., the table 104) stored in a storage unit (e.g., the memory 103). For example, the control circuit may utilize Table 1.

TABLE 1

| External connector | First switch 450 | Second switch 460 | Third switch 470 | Note |
|---|---|---|---|---|
| Not inserted | Open | First antenna element 430 and ground terminal 410 are connected | Open | |
| Inserted | Short-circuited | Second antenna element 480 and ground terminal 410 are connected | Short-circuited | Slot antenna type |
| Inserted | Short-circuited | Second antenna element 480 and terminal 461 are connected | Short-circuited | Loop antenna type, electricity is feed to terminal 461 |

The same receptacle 420 may accommodate various external connectors 10. For example, the receptacle 420 may be compatible with USB 2.0, USB 3.0, a lightening cable, and a power charging cable. The control circuit of the electronic device 400 may recognize the type of the external connector 10 connected thereto, and may connect another suitable antenna element (e.g., the third antenna element or the fourth antenna element) to the second switch 460 and the third switch 470. In this case, although the first switch 450 and the third switch 470 are of a single-pole/single-throw (SPST) type, the second switch 460 may have a switch structure corresponding to a single-pole/double-throw type depending on the number of the connectible antenna elements.

Figure 4C:
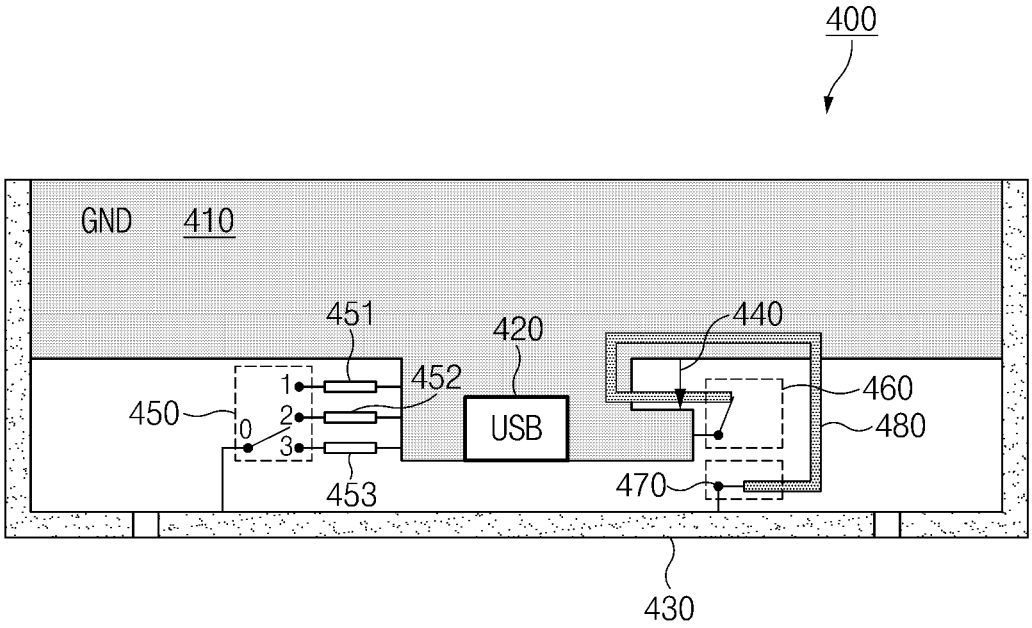
FIG. 4C illustrates an antenna structure having an electrical path that is changed by using a lumped element according to an embodiment of the present disclosure.

FIG. 4C illustrates an antenna structure having an electrical path that is changed by using a lumped element according to an embodiment of the present disclosure.

Referring to FIG. 4C, the first switch 450 may connect terminal 0 that is connected to the first antenna element 430 and one of terminals 1, 2, and 3 that are connected to the ground plane 410. Lumped elements 451, 452, and 453 are arranged between terminal 1, 2, and 3 and the ground plane 410, respectively.

When an external connector is inserted into the receptacle 420, a low frequency band of which a signal may be received by an antenna of the electronic device 400 may be changed depending on to which one of terminals 1, 2, and 3 terminal 0 is connected. For example, when the lumped element is an inductor, the central frequency band at which a resonance is generated may be lowered as the inductance (value L) increases. If the lumped element is a capacitor, the central frequency band may be shifted to a higher frequency by adjusting the capacitance (value C).

For example, when the lumped element 451 has L of 6.8 nH, the lumped element 452 has L of 2.2 nH, and the lumped element 453 has C of 39 pF, a Table 2, as shown below, may be referenced by the control circuit. Although it is assumed that the antenna is a slot antenna in Table 2, this table may be similarly applied when the antenna is a loop antenna.

TABLE 2

| External connector | First switch 450 | Second switch 460 | Third switch 470 | Target frequency band |
|---|---|---|---|---|
| Not inserted | Open | First antenna element 430 and ground terminal 410 are connected | Open | |
| Inserted | Terminal 0 is connected to terminal 1 | Second antenna element 480 and ground terminal 410 are connected | Short-circuited | 700 MHz |
| Inserted | Terminal 0 is connected to terminal 2 | Second antenna element 480 and ground terminal 410 are connected | Short-circuited | 800 MHz |
| Inserted | Terminal 0 is connected to terminal 3 | Second antenna element 480 and ground terminal 410 are connected | Short-circuited | 900 MHz |

For example, when a roaming service is used in another nation where an electronic device 400 that uses a band of LTE Band 13 (750 MHz) provides Band 5 (850 MHz), a communication frequency may be changed by connecting terminal 2 to terminal 0, instead of terminal 1. In addition, the permittivity of a peripheral portion of the antenna is influenced by a material (target), such as a human body, which influences the performance of the antenna when the human body approaches the electronic device 400 or grips the electronic device 400, the permittivity or the antenna performance may be compensated for by changing a terminal to which a switch is connected.

Figure 5A:
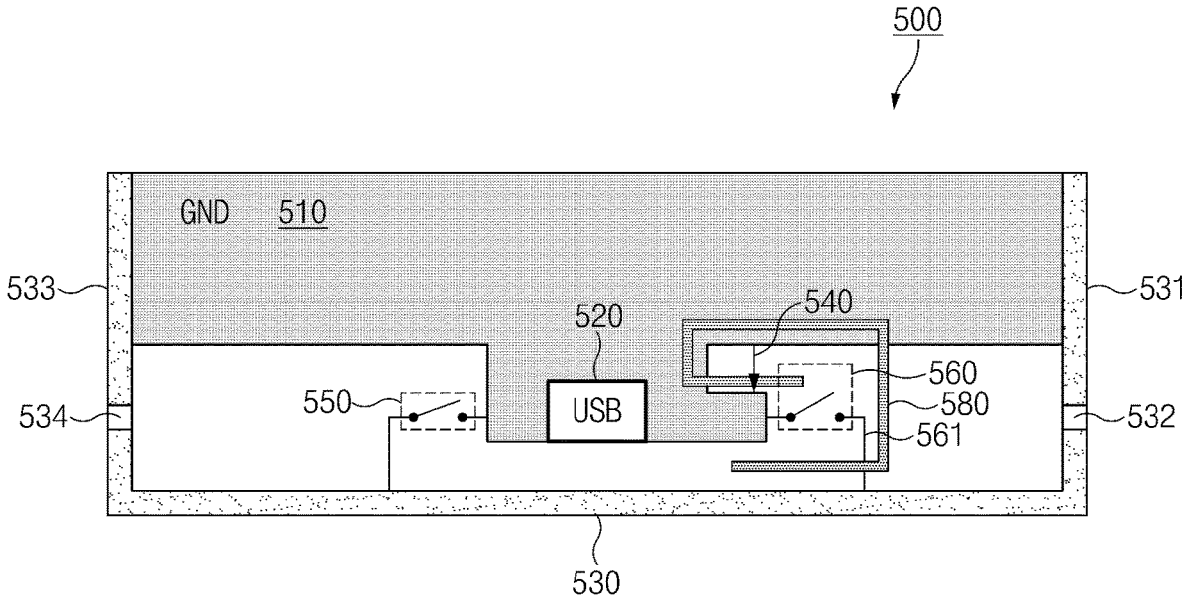
FIG. 5A illustrates an antenna that includes a switch for changing an antenna radiator in correspondence to insertion of an external connector according to an embodiment of the present disclosure.

FIG. 5A illustrates an antenna that includes a switch for changing an antenna radiator in correspondence to insertion of an external connector according to an embodiment of the present disclosure. In describing FIG. 5A, a repetitive description of components similar to those described above will be omitted.

Referring to FIG. 5A, as compared with the electronic device 400, in an electronic device 500, the third switch 470 is omitted and a second antenna element 580 extends along a first antenna element 530.

more specifically, the electronic device 500 includes a first switch 550 and a second switch 560, and includes the first antenna element 530 and the second antenna element 580. A portion of the second antenna element 580 is arranged in parallel to a portion of the first antenna element 530, and electricity may be fed to the first antenna element 530 through coupling when electricity is fed from the feeding unit to the second antenna element 580 through the arrangement structure.

The length of the first antenna element 530 of the electronic device 500 may be determined by insulation areas 532 and 534 provided on a side surface of the electronic device 500, instead of a lower end of the electronic device 500 on the x-y plane. Alternatively, one of the insulation areas may be situated at a lower end of the electronic device 500 and the other one may be situated on a side surface of the electronic device 500.

The first switch 550 may connect the ground plane 510 and the first antenna element 530. The second switch 560 may selectively connect the first antenna element 530 and the second antenna element 580. Unlike in the embodiment of FIG. 4A, because there is no switch that connects the first antenna element 530 and the second antenna element 580, the antenna structure of FIG. 5A may still correspond to the IFA type. Because a coupling structure is added in the embodiment of FIG. 5A, the performance of the antenna may be secured by using the first antenna element 530 short-circuited by the first switch 550 as a coupling structure.

Figure 5B:
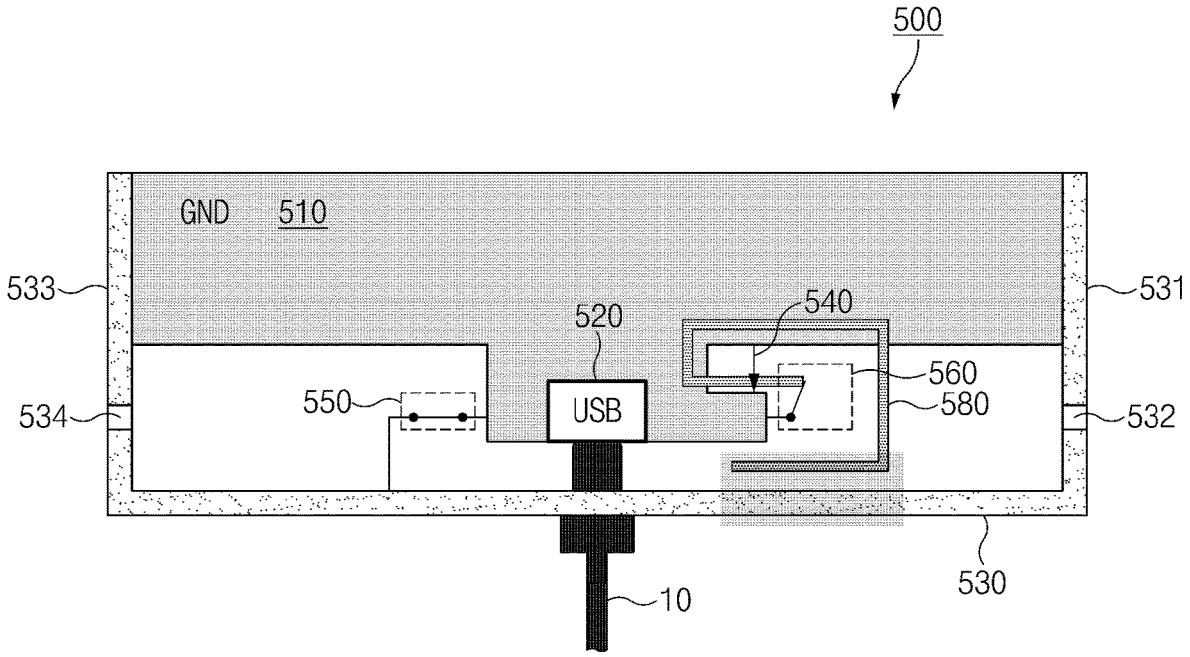
FIG. 5B illustrates a location of a switch when an external connector is inserted into an electronic device according to an embodiment of the present disclosure.

FIG. 5B illustrates a location of a switch when an external connector is inserted into an electronic device according to an embodiment of the present disclosure.

Referring to FIG. 5B, when the external connector 10 is inserted into the receptacle 520, the feeding unit 540 provides electricity to the second antenna element 580 and the first antenna element 530 is simply short-circuited from the ground plane 510 by the first switch 550, but cannot be directly provided with electricity. However, because coupling feeding occurs at the shaded part and the first antenna element 530 is operated as an antenna radiator, the performance of the antenna may be secured.

Figure 6:
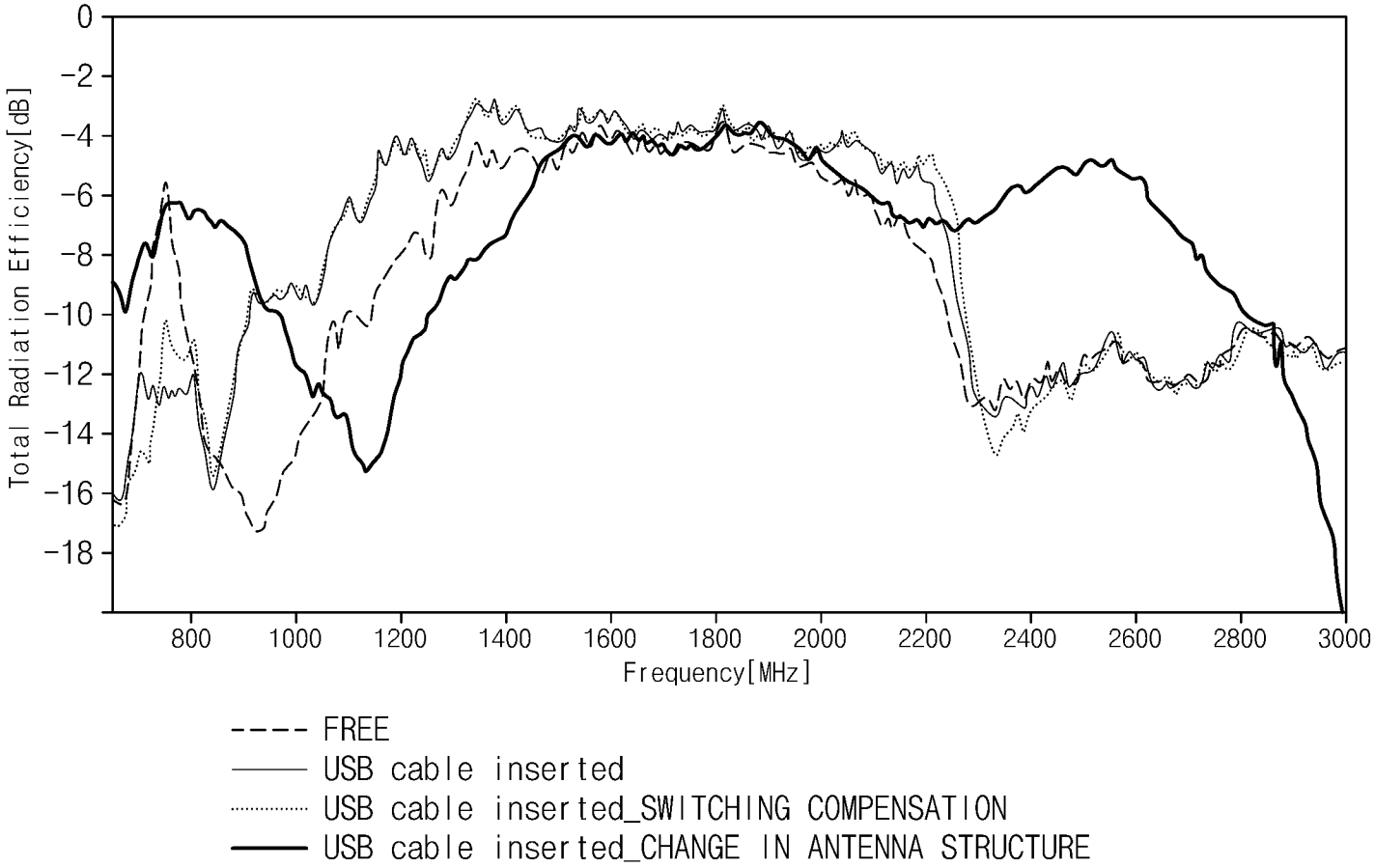
FIG. 6 is a graph depicting a change of radiation efficiency when an antenna structure according to an embodiment of the present disclosure is applied to a smartphone that supports wireless communication.

FIG. 6 is a graph depicting a change of radiation efficiency when an antenna structure according to an embodiment of the present disclosure is applied to a smartphone that supports wireless communication.

Referring to FIG. 6, a radiation efficiency in a basic state, i.e., when a USB cable is not connected to a USB port, is indicated by a dashed line. As indicated by the dashed line, the radiation efficiency is high at a frequency band corresponding to GSM, 850 MHz, or WCDMA, 2100 MHz.

A radiation efficiency when the USB cable is connected to the smartphone is indicated by a solid line. As compared with the radiation efficiency indicated by the dotted line, the radiation efficiency indicated by the solid line rapidly decreases in the vicinity of a low frequency band of GSM 850 MHz. That is, a USB cable connected to the smartphone lowers the performance of the antenna.

In a graph that depicts radiation efficiency when the USB cable is connected to the smartphone and the compensation using the switch illustrated in FIG. 2 is applied, as indicated by a dotted line, the radiation efficiency is partially improved at a low frequency band.

The radiation efficiency, when the USB cable is connected to the smartphone and the antenna structure of FIG. 4A is applied, is indicated by a thick solid line. As described for FIG. 4A, the performance of a band of GSM 850 MHz may be secured again as the antenna type is changed from an IFA type to a slot antenna type.

Figure 7A:
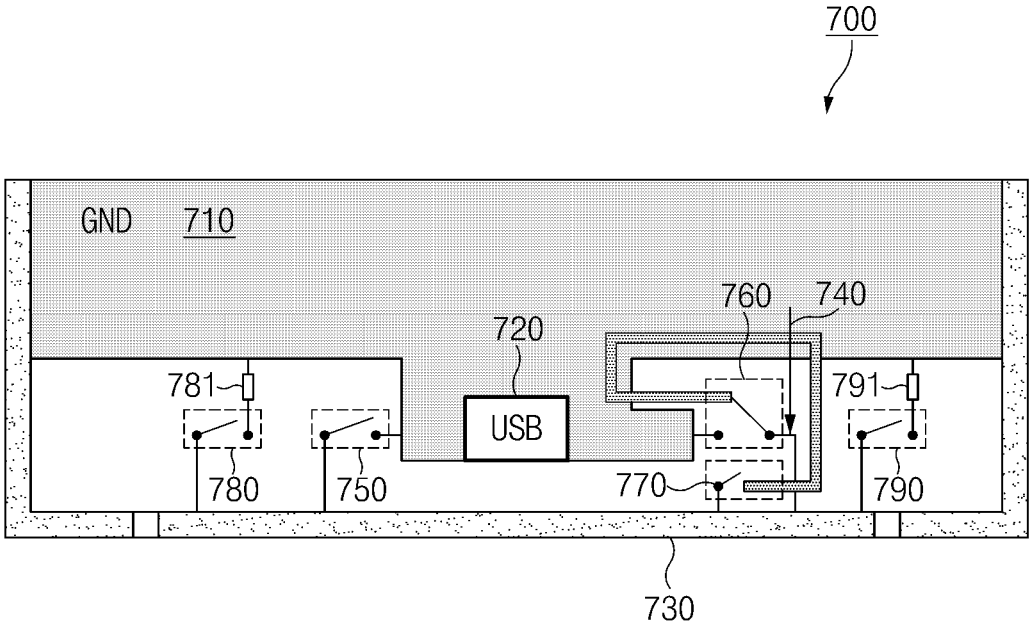
FIG. 7A illustrates an antenna that includes a switch for changing an antenna radiator depending on a grip state of an electronic device according to an embodiment of the present disclosure.

FIG. 7A illustrates an antenna that includes a switch for changing an antenna radiator depending on a grip state of an electronic device according to an embodiment of the present disclosure. In describing FIG. 7A, a repetitive description of components similar to those described above will be omitted. For example, the modification (e.g., an arrangement of a lumped element in a switch terminal) that may be applied to the above-mentioned antenna structure may be applied to the example of FIG. 7A. As another example, a fourth switch 780 and a fifth switch 790 of FIG. 7A, which are added, may include a lumped element 781 and a lumped element 791, respectively, between a ground plane 710 and the terminal.

An electronic device 700 illustrated in FIG. 7A has a configuration that is similar to that of the electronic device 400 of FIG. 4. However, as compared with the electronic device 400, the feeding unit 740 which feeds current to the antenna element feeds a terminal that connects the second switch 760 and the antenna element 730 and the electronic device 700 further includes a fourth switch 780 a fifth switch 790 The fourth switch 780 and the fifth switch 790 is respectively controlled by a processor based on whether the electronic device 700 is gripped by the left hand or by the right hand. Because the configurations of the first switch 750, the second switch 760, and the third switch 770 are the same as or similar to those of the first switch 450, the second switch 460, and the third switch 470, a detailed description thereof will be omitted.

Figure 7B:
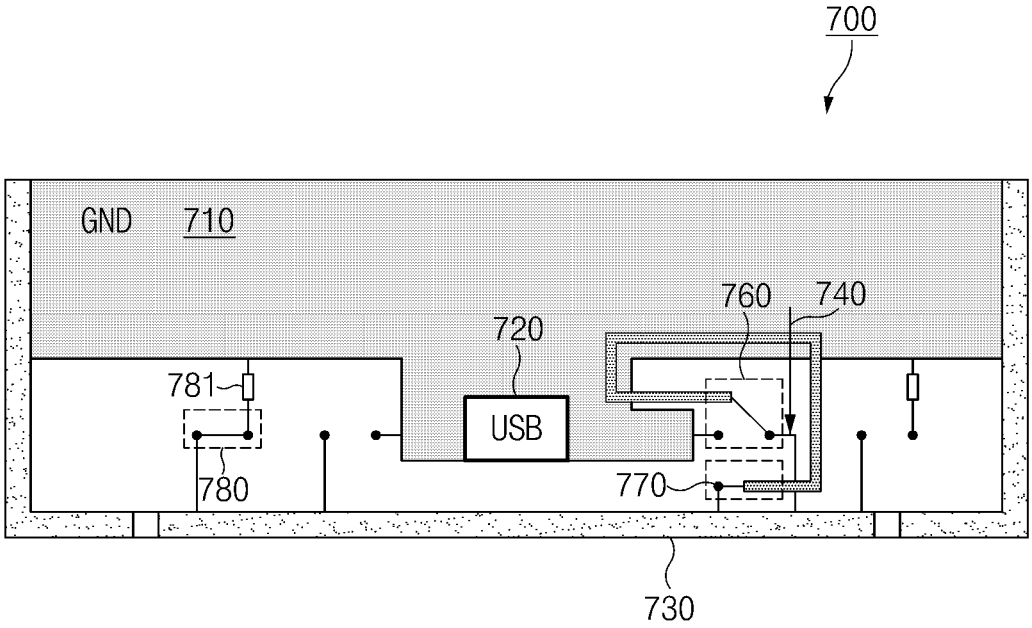
FIG. 7B illustrates a state of a switch during a left hand grip according to an embodiment of the present disclosure.

When the electronic device 700 is gripped by the left hand of the user, the electronic device 700 may control a switch such that an electrical path is formed, as illustrated in FIG. 7B. As another example, when the electronic device 700 is gripped by the right hand of the user, the electronic device 700 may control a switch such that an electrical path is formed as illustrated in FIG. 7D.

FIG. 7B illustrates a state of a switch during a left hand grip according to an embodiment of the present disclosure. For example, the electronic device 700 may determine capacitance values between the antenna element 730 and the metal frames situated on the left and right sides of the antenna element 730, by using the metal frames as reference ground areas. A situation of the left grip or right grip may be determined by using the values to control the fifth switch 790.

Referring to FIG. 7B, the electronic device 700 may change the antenna pattern to a loop antenna in response to a left grip. For example, if the left grip is detected, the electronic device 700 opens a first switch 750, controls the second switch 760 to connect the antenna element 730 and the additional antenna radiator (e.g., a TFA), short-circuits the third switch 770, short-circuits the fourth switch 780, and opens the fifth switch 790.

Figure 7C:
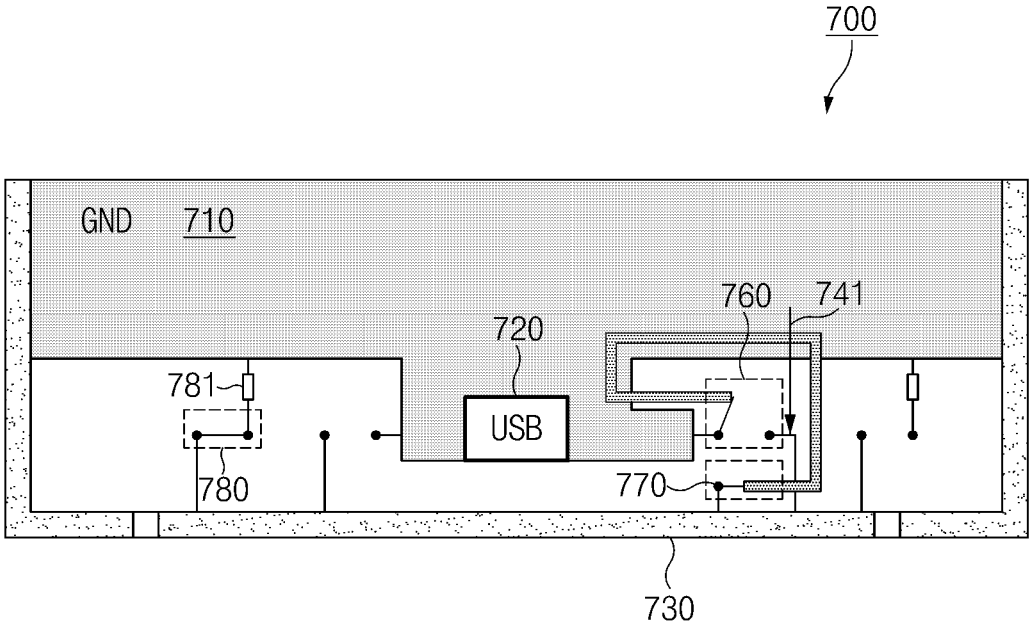
FIG. 7C illustrates a state of a switch during a left hand grip according to an embodiment of the present disclosure.
Figure 7D:
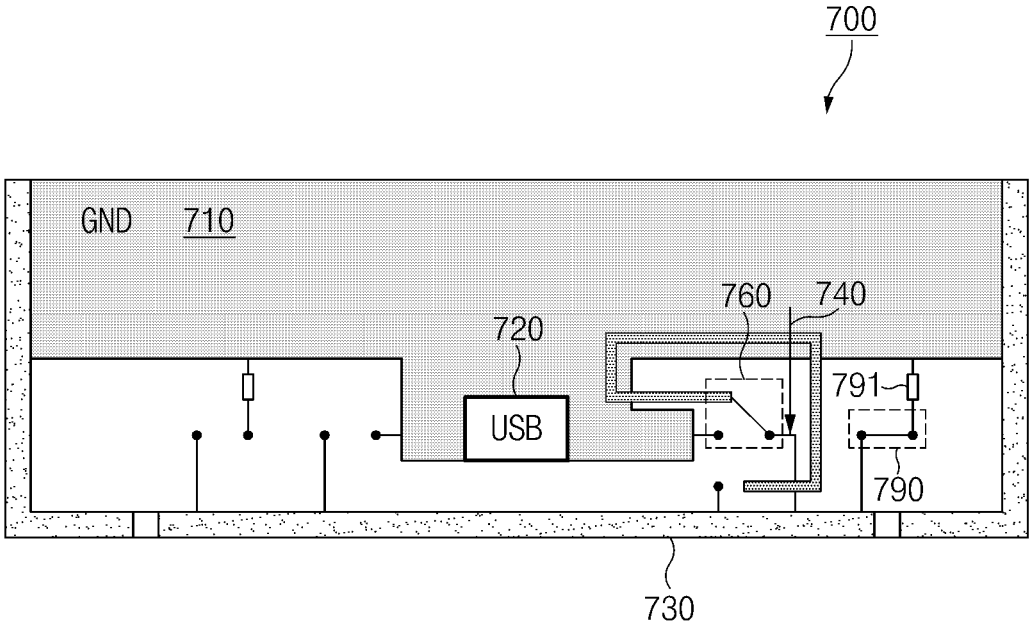
FIG. 7D illustrates a state of a switch during a right hand grip according to an embodiment of the present disclosure.

FIG. 7C illustrates a location of a switch during a left hand grip according to an embodiment of the present disclosure.

Referring to FIG. 7C, the electronic device 700 changes the antenna pattern to a slot antenna in response to the left grip. For example, if the left grip is detected, the electronic device 700 opens a first switch 750, controls the second switch 760 to connect the ground plane 710 and the additional antenna radiator, short-circuits the third switch 770, short-circuits the fourth switch 780, and opens the fifth switch 790.

FIG. 7D illustrates a state of a switch during a right hand grip according to an embodiment of the present disclosure.

Referring to FIG. 7D, the electronic device 700 changes the antenna pattern to an IFA symmetrical antenna in correspondence to the right grip. For example, if the right grip is detected, the electronic device 700 opens the first switch 750, controls the second switch 760 to connect the antenna element 730 and the additional antenna radiator, opens the third switch 770, opens the fourth switch 780, and short-circuits the fifth switch 790.

With reference to the above description, Table 3 may be referenced in response to a detected left/right grip for the control circuit of the electronic device 700 of FIG. 7.

TABLE 3

| Switch/grip | No grip | Left grip | Right grip |
|---|---|---|---|
| First switch 750 | Open | Open | Open |
| Second switch 760 | Antenna element 730 and ground plane 710 are connected | Antenna element 730 and additional radiator (TFA) are connected | Antenna element 730 and additional radiator (TFA) are connected |
| Third switch 770 | Open | Short-circuited | Open |
| Fourth switch 780 | Open | Short-circuited | Open |
| Third switch 790 | Open | Open | Short-circuited |
| Note | IFA | Loop | IFA symmetrical |

The operations described with reference to FIGS. 7A, 7B, 7C, and 7D may be performed when a grip occurs and an external connector is inserted into the receptacle 720. For example, when the external connector is inserted into the receptacle 720, the first switch 750 is short-circuited, the second switch 760 connects the antenna element 730 and the additional radiator, and the third switch 770 is short-circuited. In this state, if a signal (e.g., a signal corresponding to the left grip or the right grip) designated by the grip sensor is received, the control circuit may control at least one of the fourth switch 780 and the fifth switch 790 to change the electrical path or the antenna pattern.

Figure 8:
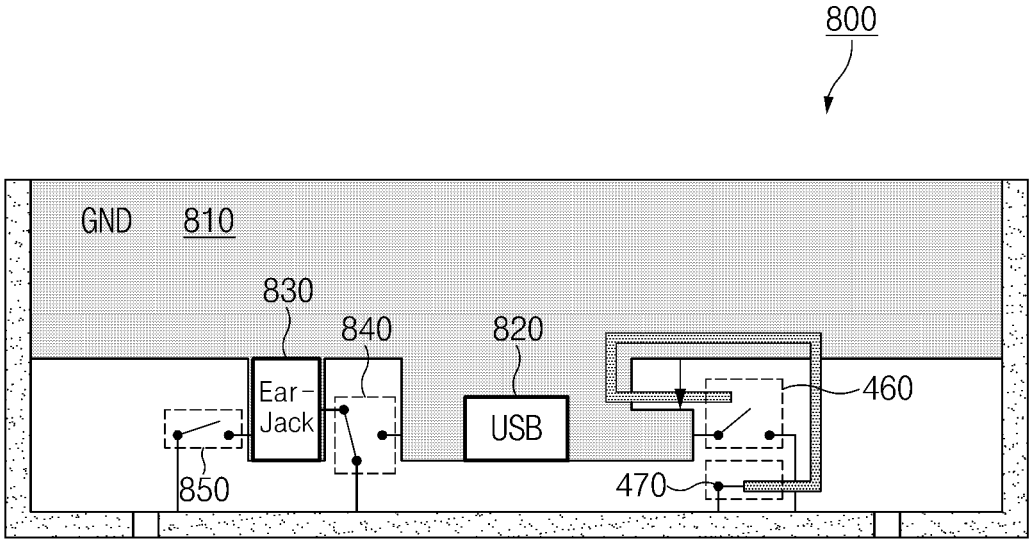
FIG. 8 illustrates an antenna structure that includes a switch for changing a type of an antenna in correspondence to insertion of an earphone jack according to an embodiment of the present disclosure.

FIG. 8 illustrates an antenna structure that includes a switch for changing a type of an antenna in correspondence to insertion of an earphone jack according to an embodiment of the present disclosure. In describing FIG. 8, a repetitive description of components similar to those described above will be omitted.

Referring to FIG. 8, an electronic device 800 has a configuration that is similar to that of the electronic device 400 of FIG. 4. However, compared with the electronic device 400, the electronic device 800 includes an earphone jack 830, i.e., a receptacle, into which an earphone connector may be inserted, a first switch 840 that may selectively connect a ground plane and the earphone jack 830 or a first antenna element 430, and a fourth switch 850 that may connect the ground plane 810 and the first antenna element 430. Because the second switch 460 and the third switch 470 are the same as those described in the description of the electronic device 400 of FIG. 4, the reference numerals are shared and a description thereof will be omitted. As another example, the earphone jack (or E/J) may include three poles or four poles like a 3.5 pi earphone.

The control circuit of the electronic device 800 may operate a switch with reference to Table 4. As another example, the control circuit may control the first switch 840 such that the first switch connects a first antenna radiator 430 and a ground GND of the earphone jack 830 and adds the fourth switch 850 to the ground, so that a signal of a relatively high frequency band (900 MHz) may be transmitted and received by additionally generating a relatively short electrical path.

TABLE 4

| Earphone jack | Not inserted | E/J inserted | E/J inserted |
|---|---|---|---|
| First switch 840 | Open | Open | Connected to GND of E/J |
| Second switch 460 | First antenna element 430 | Second antenna element 480 | Second antenna element 480 |
| Third switch 470 | Open | Short-circuited | Short-circuited |
| Fourth switch 850 | Open | Short-circuited | Short-circuited |
| Note | | 800 MHz | 900 MHz |

As described above, when various external connectors, such as a USB cable, an earphone jack, a charging cable, etc., are connected to an electronic device, shifting of resonance frequency at a specific frequency band or lowering of resonance efficiency may be prevented by properly operating a switch of an antenna in response to the insertion of the external connectors.

Figure 9:
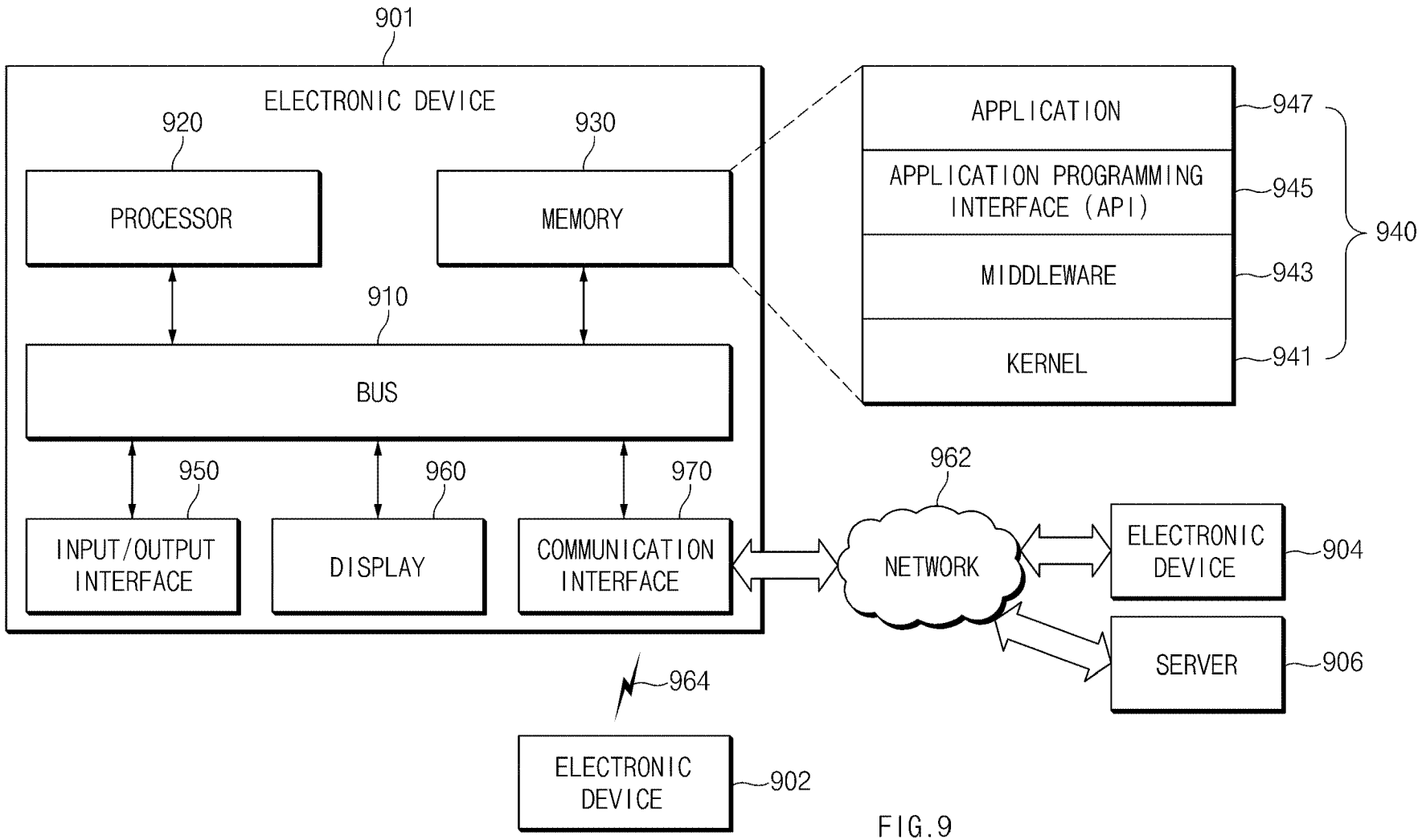
FIG. 9 illustrates an electronic device in a network environment according to an embodiment of the present disclosure.

FIG. 9 illustrates an electronic device in a network environment according to an embodiment of the present disclosure.

Referring to FIG. 9, an electronic device 901 in a network environment includes a bus 910, a processor 920, a memory 930, an input/output interface 950, a display 960, and a communication interface 970. Alternatively, at least one of the foregoing elements may be omitted or another element may be added to the electronic device 901.

The bus 910 may include a circuit for connecting the above-mentioned elements 910 to 970 to each other and transferring communications (e.g., control messages and/or data) among the above-mentioned elements.

The processor 920 may include at least one of a CPU, an AP, or a CP. The processor 920 may perform data processing or an operation related to communication and/or control of at least one of the other elements of the electronic device 901.

The memory 930 may include a volatile memory and/or a nonvolatile memory. The memory 930 may store instructions or data related to at least one of the other elements of the electronic device 901. The memory 930 stores software and a program 940. The program 940 includes a kernel 941, a middleware 943, an application programming interface (API) 945, and an application program (or an application) 947. At least a portion of the kernel 941, the middleware 943, or the API 945 may be referred to as an operating system (OS).

The kernel 941 may control or manage system resources (e.g., the bus 910, the processor 920, the memory 930, etc.) used to perform operations or functions of other programs (e.g., the middleware 943, the API 945, or the application program 947). Further, the kernel 941 may provide an interface for allowing the middleware 943, the API 945, or the application program 947 to access individual elements of the electronic device 901 in order to control or manage the system resources.

The middleware 943 may serve as an intermediary for the API 945 or the application program 947 to communicate and exchange data with the kernel 941.

Further, the middleware 943 may handle one or more task requests received from the application program 947 according to a priority order. For example, the middleware 943 may assign at least one application program 947 a priority for using the system resources of the electronic device 901 (e.g., the bus 910, the processor 920, the memory 930, etc.). The middleware 943 may handle the one or more task requests according to the priority assigned to the at least one application, thereby performing scheduling or load balancing with respect to the one or more task requests.

The API 945, which is an interface for allowing the application 947 to control a function provided by the kernel 941 or the middleware 943, may include at least one interface or function (e.g., instructions) for file control, window control, image processing, character control, etc.

The input/output interface 950 may serve to transfer an instruction or data input from a user or another external device to (an)other element(s) of the electronic device 901. The input/output interface 950 may output instructions or data received from (an)other element(s) of the electronic device 901 to the user or another external device.

The display 960 may include a liquid crystal display (LCD), a light-emitting diode (LED) display, an organic light-emitting diode (OLED) display, a microelectromechanical systems (MEMS) display, or an electronic paper display. The display 960 may present various content (e.g., a text, an image, a video, an icon, a symbol, etc.) to the user. The display 960 may include a touch screen, and may receive a touch, gesture, proximity or hovering input from an electronic pen or a part of a body of the user.

The communication interface 970 may set communications between the electronic device 901 and a first external electronic device 902, a second external electronic device 904, and/or a server 906. For example, the communication interface 970 may be connected to a network 962 via wireless communications or wired communications so as to communicate with the second external electronic device 904 or the server 906.

The wireless communications may employ at least one of cellular communication protocols such as LTE, LTE-advance (LTE-A), code division multiple access (CDMA), WCDMA, universal mobile telecommunications system (UMTS), wireless broadband (WiBro), or global system for mobile communications (GSM). The wireless communications may include a short-range communications 964. The short-range communications may include at least one of Wi-Fi, Bluetooth, near field communication (NFC), magnetic stripe transmission (MST), or GNSS.

The MST may generate a pulse by using electro-magnetic signals according to transmission data, and the pulse may cause magnetic signals.

The electronic device 901 may transmit the magnetic signals to a POS, which may detect the magnetic signals using an MST reader and obtain the transmission data by converting the magnetic signals to electronic signals.

The GNSS may include at least one of global positioning system (GPS), global navigation satellite system (GLONASS), BeiDou navigation satellite system (BeiDou), or Galileo, the European global satellite-based navigation system according to a use area or a bandwidth. Hereinafter, the term "GPS" and the term "GNSS" may be interchangeably used.

The wired communications may include at least one of USB, HDMI, recommended standard 232 (RS-232), plain old telephone service (POTS), etc. The network 962 may include at least one of telecommunications networks, for example, a computer network (e.g., local area network (LAN) or wide area network (WAN)), the Internet, or a telephone network.

The types of the first external electronic device 902 and the second external electronic device 904 may be the same as or different from the type of the electronic device 901.

The server 906 may include a group of one or more servers.

A portion or all of operations performed in the electronic device 901 may be performed in one or more of the first electronic device 902, the second external electronic device 904, and the server 906. When the electronic device 901 should perform a certain function or service, automatically or in response to a request, the electronic device 901 may request at least a portion of functions related to the function or service from the first electronic device 902, the second external electronic device 904, and/or the server 906, instead of or in addition to performing the function or service for itself. The first electronic device 902, the second external electronic device 904, and/or the server 906 may perform the requested function or additional function, and may transfer a result of the performance to the electronic device 901. The electronic device 901 may use a received result itself or additionally process the received result to provide the requested function or service. To this end, a cloud computing technology, a distributed computing technology, or a client-server computing technology may be used.

Figure 10:
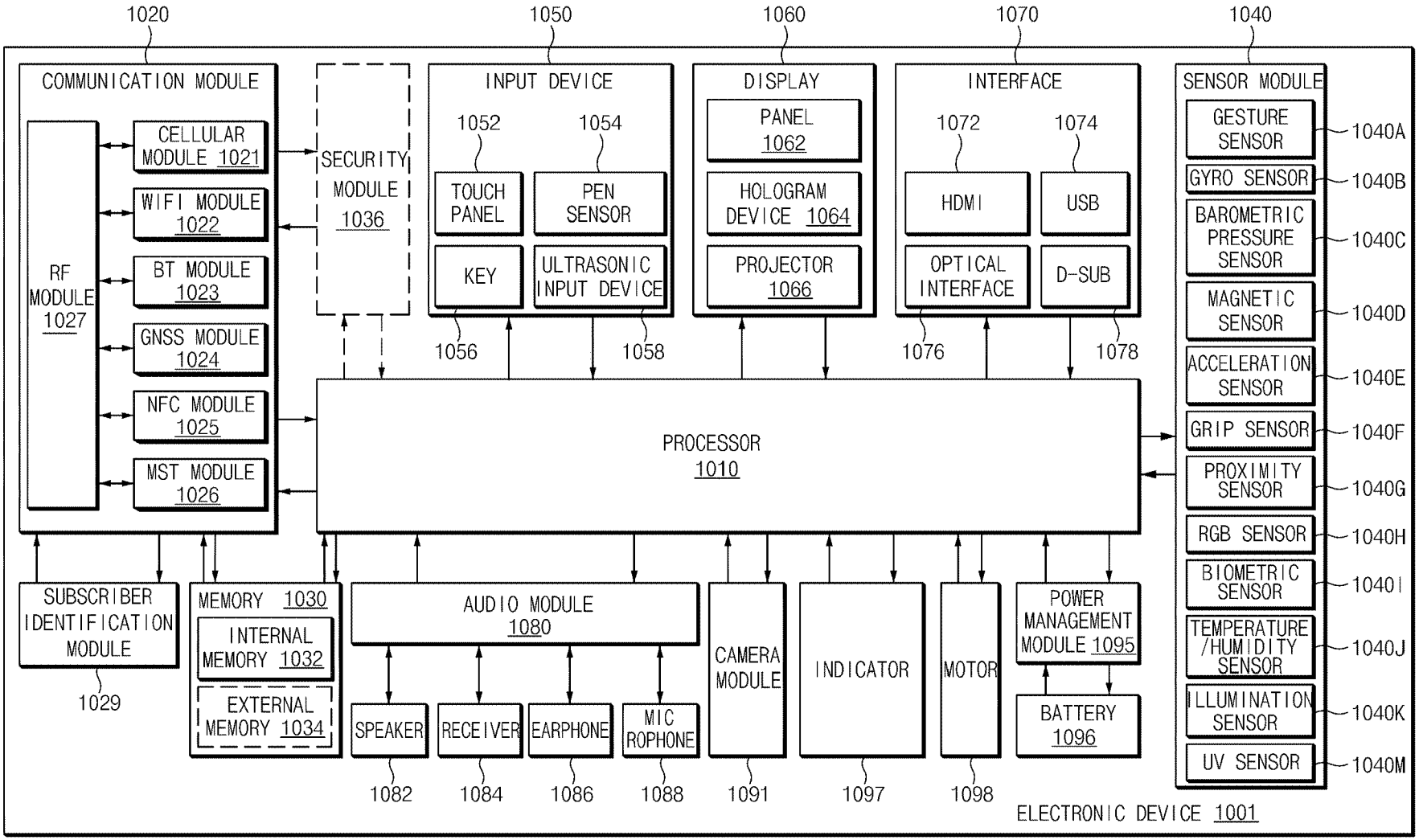
FIG. 10 is a block diagram illustrating an electronic device according to an embodiment of the present disclosure.

FIG. 10 is a block diagram illustrating an electronic device according to an embodiment of the present disclosure.

Referring to FIG. 10, the electronic device 1001 includes a processor 1010 (e.g., an AP), a communication module 1020, a subscriber identification module (SIM) 1029, a memory 1030, a sensor module 1040, an input device 1050, a display module 1060, an interface 1070, an audio module 1080, a camera module 1091, a power management module 1095, a battery 1096, an indicator 1097, and a motor 1098.

The processor 1010 may execute, or run, an OS or an application program in order to control a plurality of hardware or software elements connected to the processor 1010, process various data, and perform operations. The processor 1010 may be implemented with a system on chip (SoC). The processor 1010 may further include a graphics processing unit (GPU) and/or an image signal processor. The processor 1010 may include at least a portion of the elements illustrated in FIG. 10 (e.g., a cellular module 1021). The processor 1010 may load, on a volatile memory, an instruction or data received from at least one of the other elements (e.g., a nonvolatile memory) to process the instruction or data, and may store various data in a nonvolatile memory.

The communication module 1020 includes the cellular module 1021 (e.g., a modem), a WiFi module 1022, a Bluetooth module 1023, a GNSS module 1024, an NFC module 1025, an MST module 1026, and an RF module 1027.

The cellular module 1021 may provide a voice call service, a video call service, a text message service, or an Internet service through a communication network. The cellular module 1021 may identify and authenticate the electronic device 1001 in the communication network using the SIM 1029 (e.g., a SIM card). The cellular module 1021 may perform at least a part of the functions that may be provided by the processor 1010. The cellular module 1021 may include a CP.

Each of the WiFi module 1022, the Bluetooth module 1023, the GNSS module 1024, the NFC module 1025, and the MST module 1026 may include a processor for processing data transmitted/received through the modules. At least a part (e.g., two or more) of the cellular module 1021, the WiFi module 1022, the Bluetooth module 1023, the GNSS module 1024, the NFC module 1025, and the MST module 1026 may be included in a single integrated circuit (IC) or IC package.

The RF module 1027 may transmit/receive communication signals (e.g., RF signals). The RF module 1027 may include a transceiver, a power amplifier module (PAM), a frequency filter, a low noise amplifier (LNA), an antenna, etc. At least one of the cellular module 1021, the WiFi module 1022, the Bluetooth module 1023, the GNSS module 1024, the NFC module 1025, and the MST module 1026 may transmit/receive RF signals through a separate RF module.

The SIM 1029 may include an embedded SIM and/or a card containing the SIM, and may include unique identification information (e.g., an integrated circuit card identifier (ICCID)) or subscriber information (e.g., an international mobile subscriber identity (IMSI)).

The memory 1030 includes an internal memory 1032 and an external memory 1034. The internal memory 1032 may include at least one of a volatile memory (e.g., a dynamic random access memory (DRAM), a static RAM (SRAM), a synchronous DRAM (SDRAM), or the like), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory, a NOR flash memory, etc.)), a hard drive, and/or a solid state drive (SSD).

The external memory 1034 may include a flash drive such as a compact flash (CF) drive, a secure digital (SD) drive, a micro-SD drive, a mini-SD drive, an extreme digital (xD) drive, a multimedia card (MMC), a memory stick, etc. The external memory 1034 may be operatively and/or physically connected to the electronic device 1001 through various interfaces.

A security module 1036, which is a module including a storage space that is more secure (e.g. has a higher security level) than the memory 1030, may be a circuit for providing secure data storage and protected execution circumstances. The security module 1036 may be implemented with an additional circuit and may include an additional processor. The security module 1036 may be present in an attachable smart chip or SD card, or may include an embedded secure element (eSE), which is installed in a fixed chip. Additionally, the security module 1036 may be driven in another OS, which is different from the OS of the electronic device 1001. For example, the security module 1036 may operate based on a java card open platform (JCOP) OS.

The sensor module 1040 may measure a physical quantity or detect an operation state of the electronic device 1001 in order to convert measured or detected information into an electrical signal. The sensor module 1040 includes a gesture sensor 1040A, a gyro sensor 1040B, a barometric pressure sensor 1040C, a magnetic sensor 1040D, an acceleration sensor 1040E, a grip sensor 1040F, a proximity sensor 1040G, a color sensor 1040H (e.g., a red/green/blue (RGB) sensor), a biometric sensor 1040I, a temperature/humidity sensor 1040J, an illumination sensor 1040K, and an ultraviolet (UV) light sensor 1040M. Additionally, or alternatively, the sensor module 1040 may include an olfactory sensor (e.g., an electronic nose (E-nose) sensor), an electromyography (EMG) sensor, an electroencephalogram (EEG) sensor, an electrocardiogram (ECG) sensor, an infrared (IR) sensor, an iris recognition sensor, and/or a fingerprint sensor. The sensor module 1040 may also include a control circuit for controlling at least one sensor included therein. The electronic device 1001 may further include a processor configured to control the sensor module 1040 as a part of the processor 1010 or separately, so that the sensor module 1040 is controlled while the processor 1010 is in a reduced power, or sleep, state.

The input device 1050 includes a touch panel 1052, a (digital) pen sensor 1054, a key 1056, and an ultrasonic input device 1058. The touch panel 1052 may employ at least one of a capacitive method, a resistive method, an infrared method, and an ultraviolet light sensing method. The touch panel 1052 may further include a control circuit. The touch panel 1052 may further include a tactile layer so as to provide a haptic feedback to a user.

The (digital) pen sensor 1054 may include a sheet for recognition which is a part of a touch panel or is separate.

The key 1056 may include, for example, a physical button, an optical button, or a keypad.

The ultrasonic input device 1058 may sense ultrasonic waves generated by an input tool through a microphone 1088 so as to identify data corresponding to the ultrasonic waves sensed.

The display module 1060 includes a panel 1062, a hologram device 1064, and a projector 1066. The panel 1062 may be flexible, transparent, and/or wearable. The panel 1062 and the touch panel 1052 may be integrated into a single module. The hologram device 1064 may display a stereoscopic image in a space using a light interference phenomenon. The projector 1066 may project light onto a screen so as to display an image. The screen may be disposed internally or externally to the electronic device 1001. The display module 1060 may also include a control circuit for controlling the panel 1062, the hologram device 1064, or the projector 1066.

The interface 1070 includes an HDMI 1072, a USB 1074, an optical interface 1076, and a D-subminiature (D-sub) connector 1078. Additionally, or alternatively, the interface 1070 may include, for example, a mobile high-definition link (MHL) interface, an SD/MMC interface, or an Infrared Data Association (IrDA) interface.

The audio module 1080 may convert a sound into an electrical signal or vice versa. The audio module 1080 may process sound information input or output through a speaker 1082, a receiver 1084, an earphone 1086, or the microphone 1088.

The camera module 1091 takes a still image or a video. The camera module 1091 may include at least one image sensor (e.g., a front sensor or a rear sensor), a lens, an image signal processor (ISP), or a flash (e.g., a light emitting diode (LED) or a xenon lamp).

The power management module 1095 may manage power of the electronic device 1001. The power management module 1095 may include a power management integrated circuit (PMIC), a charger IC, a battery, or a battery gauge. The PMIC may employ a wired and/or a wireless charging method. A wireless charging method may include, for example, a magnetic resonance method, a magnetic induction method, an electromagnetic method, etc. An additional circuit for wireless charging, such as a coil loop, a resonant circuit, a rectifier, etc., may be further included.

The battery gauge may measure a remaining capacity of the battery 1096 and a voltage, current, or temperature thereof while the battery is charged. The battery 1096 may include a rechargeable battery and/or a solar battery.

The indicator 1097 may display a certain state of the electronic device 1001 or a part thereof (e.g., the processor 1010), such as a booting state, a message state, a charging state, etc.

The motor 1098 may convert an electrical signal into a mechanical vibration, and may generate a vibration or a haptic effect.

A processing device (e.g., a GPU) for supporting mobile TV may be included in the electronic device 1001. The processing device for supporting mobile TV may process media data according to the standards of digital multimedia broadcasting (DMB), digital video broadcasting (DVB), MediaFLO™, etc.

Each of the elements described herein may be configured with one or more components, and the names of the elements may be changed according to the type of an electronic device. In various embodiments of the present disclosure, an electronic device may include at least one of the elements described herein, and some elements may be omitted or other additional elements may be added. Further, some of the elements of the electronic device may be combined with each other so as to form one entity, so that the functions of the elements may be performed in the same manner as before the combination.

Figure 11:
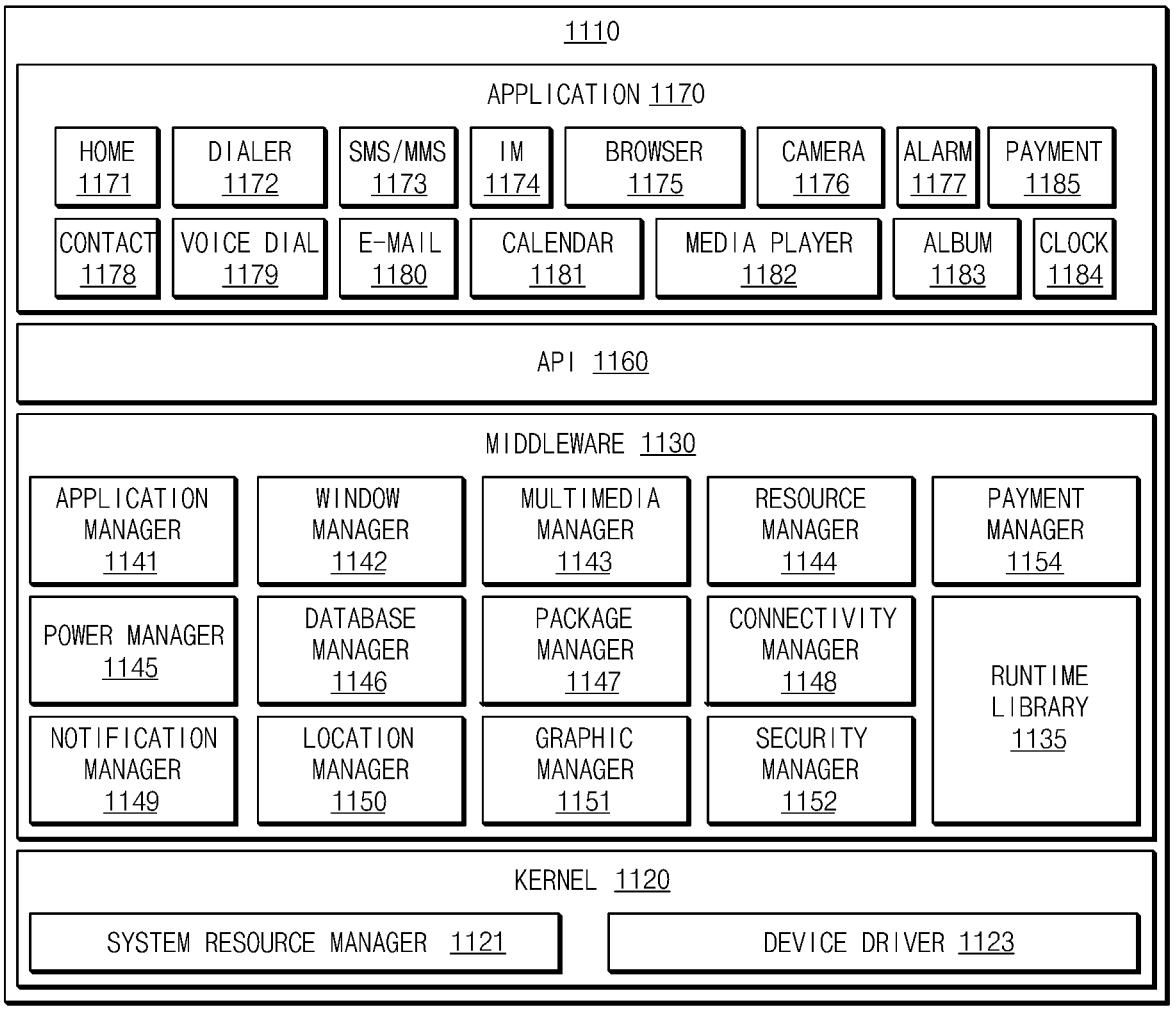
FIG. 11 is a block diagram illustrating a program module, according to an embodiment of the present disclosure.

FIG. 11 is a block diagram illustrating a configuration of a program module, according to an embodiment of the present disclosure.

A program module 1110 may include an OS for controlling resources associated with an electronic device and/or various applications which are executed on the OS.

The program module 1110 includes a kernel 1120, a middleware 1130, an API 1160, and/or an application 1170. At least part of the program module 1110 may be preloaded on the electronic device, or may be downloaded from an external electronic device.

The kernel 1120 may include, for example, a system resource manager 1121 and/or a device driver 1123. The system resource manager 1121 may control, assign, or collect system resources. The system resource manager 1121 may include a process management unit, a memory management unit, or a file system management unit. The device driver 1123 may include, for example, a display driver, a camera driver, a BT driver, a shared memory driver, a USB driver, a keypad driver, a Wi-Fi driver, an audio driver, or an inter-process communication (IPC) driver.

The middleware 1130 may provide, for example, functions the application 1170 needs in common, and may provide various functions to the application 1170 through the API 1160, such that the application 1170 efficiently uses limited system resources in the electronic device. The middleware 1130 includes at least one of a runtime library 1135, an application manager 1141, a window manager 1142, a multimedia manager 1143, a resource manager 1144, a power manager 1145, a database manager 1146, a package manager 1147, a connectivity manager 1148, a notification manager 1149, a location manager 1150, a graphic manager 1151, a security manager 1152, and a payment manager 1154.

The runtime library 1135 may include a library module used by a compiler to add a new function through a programming language while the application 1170 is executed. The runtime library 1135 may perform a function about input and output management, memory management, or an arithmetic function.

The application manager 1141 may manage, for example, a life cycle of at least one of the application 1170. The window manager 1142 may manage graphic user interface (GUI) resources used on a screen of the electronic device. The multimedia manager 1143 may determine a format utilized for reproducing various media files and may encode or decode a media file using a codec corresponding to the corresponding format. The resource manager 1144 may manage source codes of at least one of the application 1170, and may manage resources of a memory or a storage space, and the like.

The power manager 1145 may act together with, for example, a basic input/output system (BIOS) and the like, may manage a battery or a power source, and may provide power information utilized for an operation of the electronic device. The database manager 1146 may generate, search, or change a database to be used in at least one of the application 1170. The package manager 1147 may manage installation or update of an application distributed by a type of a package file.

The connectivity manager 1148 may manage, for example, wireless connection such as Wi-Fi connection or BT connection, and the like. The notification manager 1149 may display or notify events, such as an arrival message, an appointment, and proximity notification, by a method which is not disturbed to the user. The location manager 1150 may manage location information of the electronic device. The graphic manager 1151 may manage a graphic effect to be provided to the user or a user interface (UI) related to the graphic effect. The security manager 1152 may provide all security functions utilized for system security or user authentication, and the like. According to an embodiment of the present disclosure, when the electronic device has a phone function, the middleware 1130 may further include a telephony manager for managing a voice or video communication function of the electronic device.

The middleware 1130 may include a middleware module that configures combinations of various functions of the above-described components. The middleware 1130 may provide a module which specializes according to kinds of OSs to provide a differentiated function. Also, the middleware 1130 may dynamically delete some of old components or may add new components.

The API 1160 may be, for example, a set of API programming functions, and may be provided with different components according to OSs. For example, one or two or more API sets may be provided according to platforms.

The application 1170 includes one or more of, for example, a home application 1171, a dialer application 1172, a short message service/multimedia message service (SMS/MMS) application 1173, an instant message (IM) application 1174, a browser application 1175, a camera application 1176, an alarm application 1177, a contact application 1178, a voice dial application 1179, an e-mail application 1180, a calendar application 1181, a media player application 1182, an album application 1183, a clock application 1184, a payment application 1185, a health care application (e.g., an application for measuring quantity of exercise or blood sugar, and the like), or an environment information application (e.g., an application for providing atmospheric pressure information, humidity information, or temperature information, and the like), and the like.

The application 1170 may include an information exchange application for exchanging information between the electronic device and an external electronic device. The information exchange application may include, for example, a notification relay application for transmitting specific information to the external electronic device or a device management application for managing the external electronic device.

The notification relay application may include a function of transmitting notification information, which is generated by other applications (e.g., the SMS/MMS application, the e-mail application, the health care application, or the environment information application, and the like) of the electronic device, to the external electronic device. Also, the notification relay application may receive, for example, notification information from the external electronic device, and may provide the received notification information to the user of the electronic device.

The device management application may manage (e.g., install, delete, or update), for example, at least one (e.g., a function of turning on/off the external electronic device itself (or partial components) or a function of adjusting brightness (or resolution) of a display) of the functions of the external electronic device, which communicates with the electronic device, an application that operates in the external electronic device, or a service (e.g., a call service or a message service) provided from the external electronic device.

The application 1170 may include an application (e.g., the health card application of a mobile medical device) that is preset according to attributes of the external electronic device. The application 1170 may include an application received from the external electronic device. The application 1170 may include a preloaded application or a third party application which may be downloaded from a server. Names of the components of the program module 1110 may differ according to kinds of OSs.

At least part of the program module 1110 may be implemented with software, firmware, hardware, or at least two or more combinations thereof. At least part of the program module 1110 may be implemented (e.g., executed) by, for example, a processor. At least part of the program module 1110 may include, for example, a module, a program, a routine, sets of instructions, or a process, and the like for performing one or more functions.

Herein, the term "module" may represent a unit including one of hardware, software and firmware or a combination thereof. The term "module" may be interchangeably used with the terms "unit", "logic", "logical block", "component" and "circuit". A "module" may be a minimum unit of an integrated component or may be a part thereof. A "module" may be a minimum unit for performing one or more functions or a part thereof. A "module" may be implemented mechanically or electronically. For example, a "module" may include at least one of an application-specific integrated circuit (ASIC) chip, a field-programmable gate array (FPGA), and a programmable-logic device for performing some operations, which are known or will be developed.

At least a part of devices (e.g., modules or functions thereof) or methods (e.g., operations) according to various embodiments of the present disclosure may be implemented as instructions stored in a computer-readable storage medium in the form of a program module. When the instructions are performed by a processor (e.g., the processor 101), the processor may perform functions corresponding to the instructions. The computer-readable storage medium may be the memory 103.

A computer-readable recording medium may include a hard disk, a floppy disk, a magnetic medium (e.g., a magnetic tape), an optical medium (e.g., CD-ROM, digital versatile disc (DVD)), a magneto-optical medium (e.g., a floptical disk), or a hardware device (e.g., a ROM, a RAM, a flash memory, etc.). The program instructions may include machine language codes generated by compilers and high-level language codes that can be executed by computers using interpreters. The above-mentioned hardware device may be configured to be operated as one or more software modules for performing operations of various embodiments of the present disclosure and vice versa.

For example, an electronic device may include a processor and a memory for storing computer-readable instructions. The memory may include instructions for performing the above-mentioned various methods or functions when executed by the processor.

A module or a program module according to various embodiments of the present disclosure may include at least one of the above-mentioned elements, or some elements may be omitted or other additional elements may be added. Operations performed by the module, the program module or other elements according to various embodiments of the present disclosure may be performed in a sequential, parallel, iterative or heuristic way. Further, some operations may be performed in another order or may be omitted, or other operations may be added.

While the present disclosure has been shown and described with reference to certain embodiments thereof, it will be understood by those skilled in the art that various changes in form and details may be made therein without departing from the scope of the present disclosure. Therefore, the scope of the present disclosure should not be defined as being limited to the embodiments, but should be defined by the appended claims and equivalents thereof.

What is claimed is:

1. An electronic device comprising:

a ground plane;

a receptacle that accommodates an external connector;

a first antenna radiator;

a second antenna radiator that does not form an outer frame of the electronic device;

a feeding unit configured to feed electricity to the first antenna radiator;

a first switch configured to connect the first antenna radiator and the ground plane;

a second switch configured to selectively connect the feeding unit to the first antenna radiator or a first end of the second antenna radiator;

a third switch configured to connect the first antenna radiator and a second end of the second antenna radiator; and a control circuit, which is electrically connected to at least one of the first switch, the second switch, and the third switch, wherein the control circuit is configured to short-circuit the first switch and the third switch, and to connect the second switch to the first end of the second antenna radiator, in response to the external connector being inserted into the receptacle.

2. The electronic device of claim 1, wherein the first switch physically contacts the receptacle.

3. The electronic device of claim 1, wherein the first antenna radiator forms at least a portion of an-the outer frame of the electronic device.

4. The electronic device of claim 3, wherein the first antenna radiator comprises an opening, through which the external connector is inserted into the receptacle.

5. The electronic device of claim 1, wherein the control circuit is further configured to:

if the first switch, the second switch, and the third switch are opened, operate the first antenna radiator as an inverted-F antenna (IFA); and if the first switch, the second switch, and the third switch are short-circuited, operate the first antenna radiator and the second antenna radiator as slot antennas.

6. The electronic device of claim 1, wherein the receptacle comprises a USB port.

7. The electronic device of claim 1, wherein the receptacle comprises an earphone jack.

8. The electronic device of claim 1, wherein the receptacle is connected to the ground plane through an inductor.

9. The electronic device of claim 1, wherein the first switch comprises a lumped element.

10. The electronic device of claim 1, further comprising a grip sensor, wherein the control circuit is further configured to change an electrical path including the first antenna radiator and the second antenna radiator in response to a type of a grip that is received from the grip sensor while the external connector is inserted into the receptacle.

11. The electronic device of claim 1, wherein a portion of the second antenna radiator is arranged in parallel to a portion of the first antenna radiator, and wherein electricity is fed to the first antenna radiator through coupling, when electricity is fed to the second antenna radiator.

12. The electronic device of claim 1, wherein the second antenna radiator comprises one of:

a thin film antenna (TFA);

a flexible printed circuit board (FPCB);

a bracket; and stainless use steel (SUS).

13. The electronic device of claim 1, wherein the second antenna radiator comprises a laser direct structuring (LDS) antenna.

14. The electronic device of claim 1, wherein the control circuit is further configured to open the first switch and connect the second switch to the first antenna radiator, when the external connector is separated from the receptacle.

* * * * *